US008674887B2

(12) United States Patent
Sanz et al.

(10) Patent No.: US 8,674,887 B2
(45) **Date of Patent: *Mar. 18, 2014**

(54) MULTI-BAND MONOPOLE ANTENNA FOR A MOBILE COMMUNICATIONS DEVICE

(75) Inventors: Alfonso Sanz, Barcelona (ES); Carles Puente Baliarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 0 days.

This patent is subject to a terminal disclaimer.

(21) Appl. No.: 13/556,626

(22) Filed: Jul. 24, 2012

(65) Prior Publication Data

US 2012/0287001 A1 Nov. 15, 2012

Related U.S. Application Data

(63) Continuation of application No. 13/029,382, filed on Feb. 17, 2011, now Pat. No. 8,259,016, which is a continuation of application No. 12/652,974, filed on Jan. 6, 2010, now Pat. No. 8,253,633, which is a continuation of application No. 12/055,748, filed on Mar. 26, 2008, now Pat. No. 7,675,470, which is a continuation of application No. 11/713,324, filed on Mar. 2, 2007, now Pat. No. 7,403,164, which is a continuation of application No. 11/124,768, filed on May 9, 2005, now Pat. No. 7,411,556, which is a continuation of application No. PCT/EP02/14706, filed on Dec. 22, 2002.

(51) Int. Cl.
*H01Q 1/24* (2006.01)

(52) U.S. Cl.
USPC ..... 343/702; 343/700 MS

(58) Field of Classification Search
USPC ..... 343/700 MS, 702, 895
See application file for complete search history.

(56) References Cited

U.S. PATENT DOCUMENTS

| | | | |
|---|---|---|---|
| 3,079,602 | A | 2/1963 | Du Hamel |
| 3,689,929 | A | 9/1972 | Moody |
| 4,038,662 | A | 7/1977 | Turner |
| 4,123,756 | A | 10/1978 | Nagata |

(Continued)

FOREIGN PATENT DOCUMENTS

| | | |
|---|---|---|
| CN | 2224466 | 4/1996 |
| EP | 0590671 | 9/1993 |

(Continued)

OTHER PUBLICATIONS

Document 0297—Defendant HTC Corporation's amended answer and counterclaim to plaintiff's second amended complaint, Defendants, Feb. 25, 2010.

(Continued)

*Primary Examiner* — Tan Ho
(74) *Attorney, Agent, or Firm* — Edell, Shapiro & Finnan, LLC

(57) ABSTRACT

A multi-band monopole antenna for a mobile communications device includes a common conductor coupled to both a first radiating arm and a second radiating arm. The common conductor includes a feeding port for coupling the antenna to communications circuitry in a mobile communications device. In one embodiment, the first radiating arm includes a space-filling curve. In another embodiment, the first radiating arm includes a meandering section extending from the common conductor in a first direction and a contiguous extended section extending from the meandering section in a second direction.

20 Claims, 7 Drawing Sheets

(56) References Cited

U.S. PATENT DOCUMENTS 4,318,109 A 3/1982 Weathers
4,356,492 A 10/1982 Kaloi
4,389,651 A 6/1983 Tomasky
4,536,725 A 8/1985 Hubler
4,571,595 A 2/1986 Phillips et al.
4,578,654 A 3/1986 Tait
4,608,572 A 8/1986 Blakney
4,827,271 A 5/1989 Berneking
4,843,468 A 6/1989 Drewery
4,860,019 A 8/1989 Jiang
4,907,011 A 3/1990 Kuo
5,014,346 A 5/1991 Phillips
5,075,691 A 12/1991 Garay
5,248,988 A 9/1993 Makino
5,307,075 A 4/1994 Huynh
5,337,065 A 8/1994 Bonnet
5,355,318 A 10/1994 Dionnet et al.
5,363,114 A 11/1994 Shoemaker
5,410,322 A 4/1995 Sonoda
5,453,752 A 9/1995 Wang
5,457,469 A 10/1995 Diamond et al.
5,557,293 A 9/1996 McCoy
5,572,223 A 11/1996 Phillips
5,608,417 A 3/1997 De Vall
5,809,433 A 9/1998 Thompson
5,870,066 A 2/1999 Asakura et al.
5,872,546 A 2/1999 Ihara et al.
5,898,404 A 4/1999 Jou
5,918,183 A 6/1999 Janky
5,926,139 A 7/1999 Korisch
5,929,825 A 7/1999 Niu et al.
5,933,330 A 8/1999 Beutler et al.
5,936,587 A 8/1999 Gudilev
5,943,020 A 8/1999 Liebendoerfer et al.
5,963,871 A 10/1999 Zhinong et al.
5,966,098 A 10/1999 Qi et al.
5,986,609 A 11/1999 Spall
5,986,610 A 11/1999 Miron
5,990,838 A 11/1999 Burns et al.
5,990,849 A 11/1999 Salvail
5,995,052 A 11/1999 Sadler et al.
6,011,518 A 1/2000 Yamagishi
6,011,699 A 1/2000 Murray
6,031,505 A 2/2000 Qi et al.
6,087,990 A 7/2000 Thill et al.
6,094,179 A 7/2000 Davidson
6,097,339 A 8/2000 Filipovic
6,104,349 A 8/2000 Cohen
6,111,545 A 8/2000 Saari
6,112,102 A 8/2000 Zhinong
6,122,533 A 9/2000 Zhang et al.
6,130,651 A 10/2000 Yanagisawa et al.
6,140,966 A 10/2000 Pankinaho
6,140,975 A 10/2000 Cohen
6,141,540 A 10/2000 Richards et al.
6,147,655 A 11/2000 Roesner
6,160,513 A 12/2000 Davidson et al.
6,166,694 A 12/2000 Ying
6,181,281 B1 1/2001 Desclos et al.
6,195,048 B1 2/2001 Chiba et al.
6,198,442 B1 3/2001 Rutkowski
6,201,501 B1 3/2001 Arkko et al.
6,204,826 B1 3/2001 Rutkowski et al.
6,211,826 B1 4/2001 Aoki
6,215,474 B1 4/2001 Shah
6,236,366 B1 5/2001 Yamamoto et al.
6,239,765 B1 5/2001 Johnson et al.
6,243,592 B1 6/2001 Nakada et al.
6,259,407 B1 7/2001 Tran
6,266,023 B1 7/2001 Nagy et al.
6,266,538 B1 7/2001 Waldron
6,271,794 B1 8/2001 Geeraert
6,275,198 B1 8/2001 Kenoun
6,281,846 B1 8/2001 Puente Baliarda
6,285,327 B1 9/2001 See
6,288,680 B1 9/2001 Tsuru et al.
6,300,914 B1 10/2001 Yang
6,307,511 B1 10/2001 Ying et al.
6,317,084 B1 11/2001 Chen
6,329,951 B1 12/2001 Wen et al.
6,329,962 B2 12/2001 Ying
6,337,663 B1 1/2002 Chi-Ming
6,337,667 B1 1/2002 Ayala et al.
6,343,208 B1 1/2002 Ying
6,352,434 B1 3/2002 Emmert
6,353,443 B1 3/2002 Ying
6,366,243 B1 4/2002 Isohalata
6,384,790 B2 5/2002 Dishart et al.
6,408,190 B1 6/2002 Ying
6,417,816 B2 7/2002 Sadler et al.
6,445,352 B1 9/2002 Cohen
6,452,553 B1 9/2002 Cohen
6,452,556 B1 9/2002 Ha
6,459,413 B1 10/2002 Tseng et al.
6,476,769 B1 11/2002 Lehtola
6,483,462 B2 11/2002 Weinberger
6,535,170 B2 3/2003 Sawamura et al.
6,549,789 B1 4/2003 Kfoury
6,614,400 B2 9/2003 Egorov
6,664,930 B2 12/2003 Wen et al.
6,674,405 B2 1/2004 Wang
6,693,604 B2 2/2004 Washiro et al.
6,697,022 B2 2/2004 Ponce De Leon et al.
6,741,215 B2 5/2004 Grant et al.
6,762,723 B2 7/2004 Di Nallo
6,781,548 B2 8/2004 Wen et al.
6,801,164 B2 10/2004 Bit-Babik et al.
6,822,611 B1 11/2004 Kontogeorgakis et al.
6,831,606 B2 12/2004 Sajadinia
6,839,040 B2 1/2005 Huber
6,853,352 B2 2/2005 Nevermann
6,864,854 B2 3/2005 Dai et al.
6,882,320 B2 4/2005 Park
6,950,071 B2 9/2005 Wen
6,963,310 B2 11/2005 Horita
6,995,720 B2 2/2006 Shikata
7,015,868 B2 3/2006 Puente et al.
7,057,560 B2 6/2006 Erkocevic
7,068,230 B2 6/2006 Qi
7,069,043 B2 6/2006 Sawamura
7,081,857 B2 7/2006 Kinnunen
7,095,372 B2 8/2006 Soler Castany et al.
7,123,208 B2 10/2006 Puente et al.
7,126,537 B2 10/2006 Cohen
7,148,850 B2 12/2006 Puente et al.
7,202,822 B2 4/2007 Baliarda et al.
7,289,072 B2 10/2007 Sakurai
7,312,762 B2 12/2007 Puente Ballarda et al.
7,342,553 B2 3/2008 Soler et al.
7,394,432 B2 7/2008 Baliarda et al.
7,397,431 B2 7/2008 Baliarda et al.
7,403,164 B2 7/2008 Sanz et al.
7,411,556 B2 8/2008 Sanz et al.
7,423,592 B2 9/2008 Pros et al.
7,446,708 B1 11/2008 Nguyen et al.
7,463,199 B2 12/2008 Soler et al.
7,511,675 B2 3/2009 Puente et al.
7,528,782 B2 5/2009 Baliarda et al.
7,675,470 B2 * 3/2010 Sanz et al. ..... 343/702
8,253,633 B2 * 8/2012 Sanz et al. ..... 343/702
8,259,016 B2 * 9/2012 Sanz et al. ..... 343/702
2001/0002823 A1 6/2001 Ying
2001/0044320 A1 11/2001 Ono
2001/0050636 A1 12/2001 Weinberger
2001/0050637 A1 12/2001 Aoyama
2002/0000940 A1 1/2002 Moren et al.
2002/0044090 A1 4/2002 Bahr et al.
2002/0080088 A1 6/2002 Boyle
2002/0140615 A1 10/2002 Carles et al.
2002/0149527 A1 10/2002 Wen
2002/0175866 A1 11/2002 Gram
2002/0190904 A1 12/2002 Cohen
2003/0137459 A1 7/2003 Kim
2003/0184482 A1 10/2003 Bettin

(56) References Cited

U.S. PATENT DOCUMENTS

| | | | |
|---|---|---|---|
| 2003/0210187 | A1 | 11/2003 | Wong et al. |
| 2004/0004574 | A1 | 1/2004 | Wen |
| 2004/0009755 | A1 | 1/2004 | Yoshida |
| 2004/0027295 | A1 | 2/2004 | Huber et al. |
| 2004/0090372 | A1 | 5/2004 | Di Nallo |
| 2004/0095289 | A1 | 5/2004 | Bae et al. |
| 2004/0106428 | A1 | 6/2004 | Shoji |
| 2004/0140938 | A1 | 7/2004 | Kadambi |
| 2004/0203529 | A1 | 10/2004 | Hong et al. |
| 2004/0212545 | A1 | 10/2004 | Li |
| 2005/0237244 | A1 | 10/2005 | Annabi et al. |
| 2005/0239519 | A1 | 10/2005 | Saitou et al. |
| 2005/0259031 | A1 | 11/2005 | Sanz et al. |
| 2006/0028380 | A1 | 2/2006 | Harano |
| 2006/0033668 | A1 | 2/2006 | Ryu |
| 2006/0170610 | A1 | 8/2006 | Rabinovich et al. |
| 2007/0024508 | A1 | 2/2007 | Lee |
| 2007/0046548 | A1 | 3/2007 | Pros et al. |
| 2007/0103371 | A1 | 5/2007 | Kim |
| 2007/0152887 | A1 | 7/2007 | Castany et al. |
| 2007/0152894 | A1 | 7/2007 | Sanz et al. |
| 2007/0152984 | A1 | 7/2007 | Ording |
| 2007/0194997 | A1 | 8/2007 | Nakanishi |
| 2009/0109101 | A1 | 4/2009 | Baliarda et al. |

FOREIGN PATENT DOCUMENTS

| | | |
|---|---|---|
| EP | 0766343 | 4/1997 |
| EP | 0777293 | 6/1997 |
| EP | 0884796 | 6/1998 |
| EP | 0902472 | 3/1999 |
| EP | 0938158 | 8/1999 |
| EP | 0969375 | 1/2000 |
| EP | 0986130 | 3/2000 |
| EP | 1011167 | 6/2000 |
| EP | 1091445 | 4/2001 |
| EP | 1198027 | 10/2001 |
| EP | 0749176 | 9/2002 |
| EP | 1237224 | 9/2002 |
| EP | 1258054 | 11/2002 |
| EP | 1367671 | 12/2003 |
| ES | 2112163 | 3/1998 |
| ES | 2142280 | 5/2000 |
| GB | 2317994 | 4/1998 |
| GB | 2361584 | 10/2001 |
| JP | 62-262502 | 11/1987 |
| JP | 05007109 | 1/1993 |
| JP | 05-308223 | 11/1993 |
| JP | 06-085530 | 3/1994 |
| JP | 6252629 | 9/1994 |
| JP | 1997-246852 | 9/1997 |
| JP | 10-117108 | 5/1998 |
| JP | 10-163748 | 6/1998 |
| JP | 10-200327 | 7/1998 |
| JP | 10247808 | 9/1998 |
| JP | 10-303637 | 11/1998 |
| JP | 11-004113 | 1/1999 |
| JP | 11-027042 | 1/1999 |
| JP | 11-136015 | 5/1999 |
| JP | 11-220319 | 8/1999 |
| JP | 2001217632 | 8/2001 |
| JP | 2001-251128 | 9/2001 |
| JP | 2001332924 | 11/2001 |
| JP | 2002050919 | 2/2002 |
| JP | 2003-347835 | 12/2003 |
| TW | 554571 | 9/2003 |
| WO | 88/09065 | 11/1988 |
| WO | 96/29755 | 9/1996 |
| WO | 96/38881 | 12/1996 |
| WO | 97/06578 | 2/1997 |
| WO | 97/35360 | 11/1997 |
| WO | 98/05088 | 2/1998 |
| WO | 98/20578 | 5/1998 |
| WO | 99/03166 | 1/1999 |
| WO | 99/27608 | 6/1999 |
| WO | 99/56345 | 11/1999 |
| WO | 99/65102 | 12/1999 |
| WO | 99/67851 | 12/1999 |
| WO | 00/03451 | 1/2000 |
| WO | 00/36700 | 6/2000 |
| WO | 00/77884 | 12/2000 |
| WO | 01/08257 | 2/2001 |
| WO | 01/11721 | 2/2001 |
| WO | 01/17063 | 3/2001 |
| WO | 01/22528 | 3/2001 |
| WO | 01/26182 | 4/2001 |
| WO | 01/31747 | 5/2001 |
| WO | 01/33665 | 5/2001 |
| WO | 01/48861 | 7/2001 |
| WO | 01/54225 | 7/2001 |
| WO | 01/56111 | 8/2001 |
| WO | 02/35646 | 5/2002 |
| WO | 02/35652 | 5/2002 |
| WO | 02/078123 | 10/2002 |
| WO | 03/034538 | 4/2003 |
| WO | 03/034544 | 4/2003 |
| WO | 04/001894 | 12/2003 |
| WO | 2004/025778 | 3/2004 |
| WO | 2004/042868 | 5/2004 |
| WO | 2004/057701 | 7/2004 |
| WO | 2005/076409 | 8/2005 |

OTHER PUBLICATIONS

Document 0298—Defendant HTC America, Inc.'s amended answer and counterclaim to plaintiff's second amended complaint, Defendants, Feb. 25, 2010.

Document 0351—Plaintiff Fractus, S. A.'s answer to amended counterclaims of defendant Samsung Telecommunications America LLC's to Fractus's Second Amended Complaint, Susman Godfrey, Apr. 1, 2010.

Document 0352—Plaintiff Fractus, S. A.'s answer to amended counterclaims of defendant HTC Corporation to Fractus's Second Amended Complaint, Susman Godfrey, Apr. 1, 2010.

Document 0353—Plaintiff Fractus, S. A.'s answer to amended counterclaims of defendant HTC America, Inc. to Fractus's Second Amended Complaint, Susman Godfrey, Apr. 1, 2010.

Document 0354—Plaintiff Fractus, S. A.'s answer to amended counterclaims of defendant LG Electronics Inc., LG Electronics USA, Inc., and LG Electronics Mobilecomm USA Inc's to Fractus's Second Amended Complaint, Susman Godfrey, Apr. 1, 2010.

Document 0415—P.R. 4-3 joint claim construction statement, Susman Godfrey, Jun. 14, 2010.

Document 0423—Fractus SA's Opening Claim Construction Brief with Parties' Proposed and Agreed Constructions in the case of *Fractus SA* v. *Samsung Electornics Co. Ltd. et al.*, Susman Godfrey, Jul. 16, 2010.

Document 0428—Response of defendants Kyocera Communications, Inc; Palm Inc. And UTStarcom, Inc. to plaintiff Fractus SA's opening claim construction brief in "Case 6:09-cv-00203-LED-JDL", Defendants, Jul. 30, 2010.

Document 0429—Declaration of Jeffery D. Baxter—Including Exhibits: J, K, L, M ,N ,O, P, Q, R, S, T, U, Z, AA, KK, LL, Defendants, Jul. 30, 2010.

Document 0429-1—Declaration of Jeffery D. Baxter—Including Exhibits regarding US patent 7,411,556, Defendants, Jul. 30, 2010.

Document 0430—Defendants RIM, Samsung, HTC, LG and Pantech's response to plaintiff Fractus SA's opening claim construction brief, Defendants, Jul. 30, 2010.

Document 0430—Defendants RIM, Samsung, HTC, LG and Pantech's response to plaintiff Fractus SA's opening claim construction brief—Exhibit 1—Chart of Agreed Terms and Disputed Terms, Defendants, Jul. 30, 2010.

Document 0430—Defendants RIM, Samsung, HTC, LG and Pantech's response to plaintiff Fractus SA's opening claim construction brief—Exhibit 2—Family Tree of Asserted Patents, Defendants, Jul. 30, 2010.

(56) References Cited

OTHER PUBLICATIONS

Document 0430—Defendants RIM, Samsung, HTC, LG and Pantech's response to plaintiff Fractus SA's opening claim construction brief—Exhibit 41—Demonstrative re: counting segments, Defendants, Jul. 30, 2010.
Document 0430—Defendants RIM, Samsung, HTC, LG and Pantech's response to plaintiff Fractus SA's opening claim construction brief—Exhibit 42—Demonstrative showing how straight segments can be fitted over a curved surface, Defendants, Jul. 30, 2010.
Document 0440—Fractus's opposition to defendants' motion for summary judgement of invalidity based on indefiniteness and lack of written description for certain terms, Susman Godfrey, Aug. 16, 2010.
Document 0440-1—Expert declaration by Dr. D. Jaggard including exhibits (curriculum and datasheets from Cushcraft, Antenova, Ethertronics and Taoglas), Susman Godfrey, Aug. 16, 2010.
Document 0440-2—Declaration of Micah Howe in support of Fractus SA opposition to defendants' motion for summary judgement of invalidity based on indefiniteness and lack of written description for certain terms, Heim , Payne and Chorus LLP, Aug. 16, 2010.
Document 0452—Defendant's reply in support of their motion for summary judgment of invalidity based on indefiniteness and lack of written description for certain terms with exhibits WW, BBB, EEE, GGG, HHH, III, KKK, MMM, NNN, OOO, PPP, Q, Defendants, Aug. 30, 2010.
Document 0475—Order. Provisional claim construction and motion for summary judgement. Provisional markman order, Court, Nov. 9, 2010.
Document 0526—Memorandum order and opinion, Court, Dec. 17, 2010.
Document 0575—Fractus 's Objections to claim construction memorandum and order, Susman Godfrey, Jan. 14, 2011.
Document 0582—Memorandum opinion and order, Court, Jan. 20, 2011.
Document 0583—Defendant's notice of compliance regarding second amended invalidity contentions, Defendants, Jan. 21, 2011.
Document 0607—Declaration of Thomas E. Nelson—Exhibit A—Antenna photos, Defendants, Feb. 3, 2011.
Document 0609—Fractus' reply to defendant's motion for reconsideration of, and objections to, magistrate Judge Love's markman order, Susman Godfrey, Feb. 4, 2011.
Document 0611—Report and recommendation of United States magistrate judge, Court, Feb. 8, 2011.
Document 0622—Order adopting report and recommendation of magistrate judge, Court, Feb. 11, 2011.
Document 0624—Notice of compliance with motion practice orders, Susman Godfrey, Feb. 14, 2011.
Document 0641—Defendant HTC America, Inc's second amended answer and counterdaim to plaintiff's second amended complaint, Defendants, Dec. 25, 2011.
Document 0642—Defendant HTC Corporation's second amended answer and counterdaim to plaintiff's second amended complaint, Defendants, Feb. 25, 2011.
Document 0645—Reply brief in support of Defendant's motion for reconsideration of the court's ruling on the term "at least a portion" in the court's Dec. 17, 2010 claim construction order based on newly-available evidence, Defendants, Feb. 25, 2011.
Document 0647—Defendants Samsung Electronics Co LTD (et al) second amended answer and counterclaims to the second amended complaint of plaintiff Fractus SA—Document 647, Defendants, Feb. 28, 2011.
Document 0649—Defendants LG Electronics Inc, LG Electronics USA, and LG Electronics Mobilecomm USA Inc's second amended answer and counterclaim to second amended complaint, Defendants, Feb. 28, 2011.
Document 0657—Defendant Pantech Wireless Inc amended answer, affirmative defenses, and counterclaims to Fractus' second amended complaint, Defendants, Feb. 28, 2011.
Document 0666—Fractus's sur-reply to defendants' motion for reconsideration of the court's Dec. 17, 2010 claim construction order based on newly-available evidence, Susman Godfrey, Mar. 8, 2011.
Document 0670—Order, Court, Mar. 9, 2011.
Document 0678—Plaintiff Fractus SA's answer to second amended counterclaims of defendant HTC Corporation to Fractus's second amended complaint, Susman Godfrey, Mar. 14, 2011.
Document 0680—Plaintiff Fractus SA's answer to second amended counterclaims of defendant HTC to Fractus's second amended complaint, Susman Godfrey, Mar. 14, 2011.
Document 0694—Plaintiff Fractus SA's answer to second amended counterclaims of defendant LG Electronics to Fractus's second amended complaint, Susman Godfrey, Mar. 15, 2011.
Document 0695—Plaintiff Fractus SA's answer to second amended counterclaims of defendant Samsung to Fractus's second amended complaint, Susman Godfrey, Mar. 15, 2011.
Document 0696—Plaintiff Fractus SA's answer to amended counterclaims of defendant Pantech Wireless Inc to Fractus's second amended complaint, Susman Godfrey, Mar. 15, 2011.
Document 0715—Letter to John D. Love—Permission to file a summary judgment motion of no indefiniteness on the issues wher the Court's Report and Recommendation already has held that the claim term is not indefinite, Susman Godfrey, Mar. 18, 2011.
Document 0716—Letter to John D. Love—Permission to file a partial summary judgement motion on infringement, Susman Godfrey , LLP, Mar. 18, 2011.
Document 0721—Letter to John D. Love—Permission to file a motion for summary judgment of invalidity of the following 7 asserted claims from the MLV, patent family . . . , Defendants—Baker Botts, LLP, Mar. 18, 2011.
Document 0768—Fractus, S.A.'s objections to the Court's Mar. 9, 2011, Order, Susman Godfrey, Mar. 25, 2011.
Document 0780—Defendants' opposition to Fractus SA objections to the Court's Mar. 9, 2011 Order, Defendants—Baker Botts, LLP, Mar. 31, 2011.
Document 0783—Order, Court, Apr. 1, 2011.
Document 0841—Stipulation of Dismissal of all Claims and Counterclaims re '850 and '822, Defendants, Apr. 15, 2011.
Document 0032—Defendants LG Electronics Mobilecomm USA., Inc.'s answer and counterclaim to complaint, Defendants, Oct. 1, 2009.
Document 0064—Defendant Pantech Wireless, INC.'S answer, affirmative defenses and counterclaims to Fractus SA's Amended complaint, Defendants, Jun. 4, 2009.
Document 0066—Defendant UT Starcom, Inc's answer affirmative defenses and counterdaims to plaintiffs amended complaint, Defendants, Jun. 8, 2009.
Document 0073—Plaintiff Fractus SA' s answer to defendant Pantech Wireless, Inc' s counterclaims, Defendants, Jun. 24, 2009.
Document 0079—Plaintiff Fractus SA' s answer to defendant UTStarcom, Inc' s counterdaims, Fractus, Jun. 29, 2009.
Document 0091—Answer, affirmative defenses and counterclaims to the amended complaint for patent infringement on behalf of Defendant Personal Communications Devices Holdings, LLC, Defendants, Jul. 20, 2009.
Document 0099—Defendant Sanyo North America Corporation's partial answer to amended complaint for patent infringement, Defendants, Jul. 20, 2009.
Document 0106—Kyocera Communications Inc's answer, affirmative defenses and counterclaims to plaintiff's amended complaint, Defendants, Jul. 21, 2009.
Document 0107—Kyocera Wireless Corp's answer, affirmative defenses and counterclaims to plaintiff's amended complaint, Defendants, Jul. 21, 2009.
Document 0108—Palm Inc.'s answer, affirmative defenses and counterclaims to plaintiff's amended complaint, Defendants, Jul. 21, 2009.
Document 0111—Civil cover sheet, Susman Godfrey, May 5, 2009.
Document 0175—Defendant HTC Corporation's amended answer and counterclaim to plaintiff's second amended complaint, Defendants, Sep. 25, 2009.
Document 0176—Defendant HTC America Inc's answer and counterclaim to plaintiffs amended complaint, Defendants, Sep. 25, 2009.

(56) References Cited

OTHER PUBLICATIONS

Document 0180—Defendants Samsung Electronics Co., Ltd.'s; Samsung Electronics Research Institute's and Samsung Semiconductor Europe GMBH' s answer; and Samsung Telecommunications America LLC' s answer and counterclaim, Defendants, Oct. 1, 2009.
Document 0185—Defendants Research in Motion LTD, and Research in Motion Corporation's answers, defenses and counterclaims to plaintiff's amended complaint, Defendants, Oct. 1, 2009.
Document 0187—Defendants LG Electronics Inc., LG Electronics USA, Inc., and LG Electronics Mobilecomm USA Inc. answer and counterclaim to amended complaint, Defendants, Oct. 1, 2009.
Document 0190—Defendant HTC Corporation's First amended answer and counterclaim to plaintiff's amended complaint, Defendants, Oct. 2, 2009.
Document 0191—Defendant HTC America, Inc's first amended answer and counterclaims to plaintiff's amended complaint, Defendants, Oct. 2, 2009.
Document 0217—Defendants Research in Motion LTD, and Research in Motion Corporation's amended answer, defenses and counterclaims to plaintiff's amended complaint, Defendants, Nov. 24, 2009.
Document 0222—Second amended complaint for patent infringement, Susman Godfrey, Dec. 2, 2009.
Document 0227—Second amended complaint for patent infringement—Case 6:09-cv-00203, Fractus, Dec. 8, 2009.
Document 0235—Answer, affirmative defenses and counterclaims to the second amended complaint for patent infringement on behalf of Defendant Personal Communications Devices Holdings, LLC, Defendants, Dec. 17, 2009.
Document 0238—Defendant HTC America, Inc's answer and counterclaims to plaintiff's second amended complaint, Defendants, Dec. 21, 2009.
Document 0239—Defendant HTC Corporation's answer and counterclaims to plaintiff's second amended complaint, Defendants, Dec. 21, 2009.
Document 0241—Defendant Research in Motion LTD and Research in Motion Corporation's second answer, defenses and counterclaims to plaintiff's second amended complaint, Defendants, Dec. 21, 2009.
Document 0242—Defendant Pantech Wireless, Inc's answer, affirmative defenses and counterclaims to Fractus SA's second amended complaint, Defendants, Dec. 21, 2009.
Document 0243—Defendant Sanyo Electric Co. LTD's answer to second amended complaint for patent infringement, Defendants, Dec. 22, 2009.
Document 0244—Defendant Sanyo North America Corporation's answer to second amended complaint for patent infringement, Defendants, Dec. 22, 2009.
Document 0246—Defendant UTStarcom, Inc's answer, affirmative defenses and counterclaims to Fractus SA's second amended complaint, Defendants, Dec. 22, 2009.
Document 0247—Palm, Inc's answer, affirmative defenses and counterclaims to plaintiff's second amended complaint, Defendants, Dec. 22, 2009.
Document 0248—Kyocera Communications, Inc's answer, affirmative defenses and counterclaims to plaintiff's second amended complaint, Defendants, Dec. 22, 2009.
Document 0249—Kyocera Wireless Corp's answer, affirmative defenses and counterclaims to plaintiff's second amended complaint, Defendants, Dec. 22, 2009.
Document 0250—Defendants Samsung Electronics Co., Ltd.'s; Samsung Electronics answer and counterclaim to the second amended complaint of plaintiff Fractus, Defendants, Dec. 23, 2009.
Document 0251—Defendants LG Electronics Inc., LG Electronics USA, Inc., and LG Electronics Mobilecomm USA Inc. answer and counterclaim to second amended complaint, Defendants, Dec. 28, 2009.
Document 0252—Answer of the Sharp Defendants to plaintiff's second amended complaint, Defendants, Dec. 29, 2009.
Document 0255—Plaintiff Fractus, S. A.'s answer to defendant Personal Communications Devices Holdings, LLC's counterclaims to the Second Amended Complaint, Susman Godfrey, Jan. 4, 2010.
Document 0256—Plaintiff Fractus, S. A.'s answer to the counterclaims of defendants Research in Motion LTD. and Research in Motion Corporation to the Second Amended Complaint, Susman Godfrey, Jan. 4, 2010.
Document 0257—Plaintiff Fractus, S. A.'s answer to counterclaims of defendant Pantech Wireless, Inc. to the Second Amended Complaint, Susman Godfrey, Jan. 4, 2010.
Document 0258—Plaintiff Fractus, S. A.'s answer to defendant Kyocera Communications, Inc's Counterclaims to the Second Amended Complaint, Susman Godfrey, Jan. 4, 2010.
Document 0259—Plaintiff Fractus, S. A.'s answer to defendant Kyocera Wireless Corp's Counterclaims to the Second Amended Complaint, Susman Godfrey, Jan. 4, 2010.
Document 0260—Plaintiff Fractus, S. A.'s answer to defendant Palm, Inc's Counterclaims to the Second Amended Complaint, Susman Godfrey, Jan. 4, 2010.
Document 0261—Plaintiff Fractus, S. A.'s answer to defendant UTStarcom, Inc's Counterclaims to the Second Amended Complaint, Susman Godfrey, Jan. 4, 2010.
Document 0262—Plaintiff Fractus, S. A.'s answer to counterclaims of defendant Samsung Telecommunications America LLC to the Second Amended Complaint, Susman Godfrey, Jan. 4, 2010.
Document 0263—Plaintiff Fractus, S. A.'s answer to counterclaims of defendants LG Electronics Inc., Electronics USA, Inc., and LG Electronics Mobilecomm USA, Inc. to the Second Amended Complaint, Susman Godfrey, Jan. 4, 2010.
Document 0273—Plaintiff Fractus, S. A.'s answer to counterclaims of defendants HTC America, Inc to the Second Amended Complaint, Susman Godfrey, Jan. 14, 2010.
Document 0286—Amended answer of the Sharp defendants to plaintiff's second amended complaint, Defendants, Feb. 24, 2010.
Document 0287—Defendants Samsung Electronics Co., Ltd.'s; Samsung Electronics Research Institute's and Samsung Semiconductor Europe GMBH' s first amended answer; and Samsung Telecommunications America LLC' s first amended answer, Defendants, Feb. 24, 2010.
Document 0288—Defendants LG Electronics Inc., LG Electronics USA, Inc., and LG Electronics Mobilecomm USA Inc. First amended answer and counterclaim to second amended complaint, Defendants, Feb. 24, 2010.
Document 0290—Defendant HTC America, Inc.'s amended answer and counterclaim to plaintiff's second amended complaint, Defendants, Feb. 24, 2010.
Document 0291—Defendant HTC Corporation's amended answer and counterclaim to plaintiffs second amended complaint, Defendants, Feb. 24, 2010.
NA , Nokia 8265 , Nokia , Mar. 4, 2002.
NA , Nokia 8260 , Nokia , Sep. 8, 2000.
NA , Nokia 8210 , Nokia , Jan. 1, 1999.
NA , Nokia 3360 , Nokia , May 3, 2001.
NA , Nokia 3210 , Nokia , Jan. 1, 1999.
NA , Motorola 2000x pager , Motorola , Jun. 13, 1997.
NA , Motorola P935 , Motorola , Aug. 13, 1997.
NA , Motorola Bravo Plus pager , Motorola , Mar. 3, 1995.
NA , Motorola Advisor Gold FLX pager , Motorola , Inc , Aug. 1, 1996.
NA , Motorola Advisor Elite mobile phone—Antenna photos—User manual , Motorola , Jan. 1, 1997.
NA , Hagenuk mobile phone—Antenna photo—Technical specs—User manual , Hagenuk Telecom GmbH , Jan. 1, 1996.
NA , The handbook of antenna design—Index , Rudge, A. W. et al.—Peter Peregrinus—Institution of Electrical Engineers , Jan. 1, 1986 , 1-2.
NA , Rockwell B-1B Lancer , <http://home.att.net/~jbaugher2/newb1_2.html> , Oct. 12, 2001.
NA , Digital cellular telecommunications system (Phase2) : Abbreviations and acronyms (GSM01.04) GSM Technical Specification vs. 5.0.0 , ETSI , Mar. 1, 1996.
NA , Digital cellular telecommunications system (Phase 2+) ; Radio transmission and reception (GSM 05.05) , ETSI , Jul. 1, 1996.

(56) References Cited

OTHER PUBLICATIONS

NA , Digital cellular telecommunications system (Phase 2) : Types of Mobile Stations (MX) (GSM 02.06) , ETSI , May 9, 1996.
NA , GSM Technical specification and related materials , ETSI , Mar. 1, 1996.
NA , Digital cellular telecommunications system (Phase2). Mobile Station MS Conformance specifiaction Part 1 Conformance Specification GSM11.10-1) , ETSI , Mar. 1, 1996.
NA , IEEE Standard definitions of terms for antennas, IEEE Std. 145-1983 , Antenna Standards Committee of the IEEE Antennas and Propagation Group, USA; , Jun. 22, 1983.
Nadan , T. ; coupez , J. P. , Integration of an antenna filter device, using a multi-layer, multi-technology process , European Microwave Conference, 28th , Oct. 1, 1988 , vol. 1.
Nagai , K. ; Mikuni , Y. ; Iwasaki , H. , A mobile radio antenna system having a self-diplexing function , IEEE Transactions on Vehicular Technology , Nov. 1, 1979 , vol. 28.
Nagy , L. L , Antenna engineering handbook—Chapter 39—Automobile antennas , Volakis , J. - McGraw-Hill; 4th edition , Jan. 1, 2007, Chapter 39.
Naik , A. ; Bathnagar , P. S. , Experimental study on stacked ring coupled triangular microstrip antenna , Antenna Applications Symposium, 1994 , Sep. 21, 1994.
Nakano , Hisamatsu et al , Realization of dual frequency and wide band vswr performances using normal mode helical and inverted f antennas , Antennas and Propagation, IEEE Transactions on , Jun. 6, 1998.
Nakano ; Vichien , Dual-frequency square patch antenna with rectangular notch , Electronic Letters , Aug. 3, 1989 , vol. 25.
Neary , D. , Fractal methods in image analysis and coding , Dublin City University—www.redbrick.dcu.ie/*bolsh/thesis/node16.html and *node22.html , Jan. 22, 2001.
Nelson , Thomas R. ; Jaggard , Dwight L. , Fractals in the Imaging Sciences , J. Optical Society AM. , Jan. 1, 1999.
Ng , V. , Diagnosis of melanoma with fractal dimesions , IEEE Tencon , Jan. 1, 1993.
Nishikawa , T., Ishikawa , Y., Hattori , J. And Wakino , K. , Dielectric receiving filter with Sharp stopband using an active feedback resonator method for cellular base stations , IEEE Transactions on Microwave Theory and Techniques , Dec. 1, 1989 , vol. 37.
Nokia , Nokia MBD-11 Mobile Holder—SAR Specification , Nokia, Mar. 1, 2002.
Nokia Mobile Phones , Exhibit 9: Internal Photographs FCC ID: LJPNPW-1NB , Federal Communication Commission—FCC , Feb. 15, 2001.
Omar, Amjad A. ; Antar , Y. M. M. , A new broad band dual frequency coplanar waveguide fed slot antenna , Antennas and Propagation Society International Symposium, 1999. IEEE , Jul. 11, 1999.
Ou , J. D. , An analysis of annular, annular sector, and circular sector microstrip antennas , Antenna Applications Symposium , Sep. 23, 1981.
Pan, S. et al. , Single-feed dual-frequency microstrip antenna with two patches , Antennas and Propagation Society International Symposium, 1999. IEEE , Aug. 1, 1999.
Parker , E. A. ; A. N. A. El Sheikh , Convoluted array elements and reduced size unit cells for frequency selective surfaces , IEE Proceedings H , Feb. 1, 1991 , pp. 19-22.
Parker , S. , McGraw-Hill Dictionary of Scientific and Technical Terms (5th ed. 1994) , McGraw-Hill , Jan. 1, 1994 , p. 1542.
Parron , J. ; Rius , J. ; Romeu , J. , Study of the Koch fractal monopole in the frequency domain , Fractalcoms , May 30, 2002.
Paschen , D. A. , Broadband microstrip matching techniques , Antenna Applications Symposium , Sep. 21, 1983.
Paschen , D. A. , Structural stopband elimination with the monopole-slot antenna , Antenna Applications Symposium , Sep. 22, 1982.
Paschen , D. A. ; Olson , S. , A crossed-slot antenna with an infinite balun feed , Antenna Applications Symposium, 1995. , Sep. 20, 1995.
Peitgen & D. Saupe, H , The science of fractal images , Springer-Verlag , Jan. 1, 1988 , pp. 1-3, 24-27, 58-61.
Peitgen , H. ; Jürgens , H. ; Saupe , D. , Chaos and Fractals: New frontiers of Science , Springer , Jan. 1, 1992 , pp. 8-9.
Peitgen et al, H O , Chaos and fractals : new frontiers of science , Springer-Verlag , Jan. 1, 1992 , pp. 22-26, 62-66, 94-105, 212-219, 229-243.
Peitgen, Heinz-Otto; Jürgens, Hartmut; Saupe, Dietmar , Chaos and fractals. New frontiers of science , Springer-Verlag , Feb. 12, 1993 , pp. 212-216 ; 387-388.
Penn , A. , Fractal dimension of low-resolution medical images , Engineering in Medicine and Biology Society, 1996. Proceedings of the 18th Annual International Conference of the IEEE , Jan. 1, 1996.
Phelan , R. , A wide-band parallel-connected balun , Microwave Theory and Techniques, IEEE Transactions on , May 1, 1970.
Posio , E. , Letter to FCC—Request for confidentiality on the information accompanying the application of FCC ID: GMLNSW-4DX , Nokia Mobile Phones , Feb. 7, 2000.
Posio , E. , Letter to FCC—About GMLNPW-3 complies with ANSI/IEEE C95.1-1992 Standard for Safety Levels , Nokia Mobile Phones, Dec. 7, 2001.
Posio , E. , Letter to FCC—Request for confidentiality of the information accompanying the application of FCC ID: GMLNPW-3 , Nokia Mobile Phones , Dec. 7, 2001.
Posio , E. , Letter to FCC—Compliance Statement of GMLNPW-3 , Nokia Mobile Phones , Dec. 7, 2001.
Hyneman , R. F. ; Mayes , P. E. ; Becker , R. C. , Homing antennas for aircraft ( 450 - 2500 MC) , Symposium on the USAF antenna research and development program, 5th , Oct. 16, 1955.
IEEE Standards , Uncertainty System Check (Dipole Validation)—IEEE P1528 , Schmid and Partner Engineering AG , Jan. 1, 2003.
Ikata , O. ; Satoh , Y. ; Uchishiba , H. et al , Development of small antenna duplexer using saw filters for handheld phones , IEEE Ultrasonics Symposium , Oct. 31, 1993.
Ingerson , P. G. ; Mayes , P. E. , Asymmetrical feeders for log-periodic antennas , Symposium on the USAF antenna research and development program, 17th , Nov. 14, 1967.
Isbell , D. E. , Multiple terminal log-periodic antennas , Symposium on the USAF antenna research and development program, 8th , Oct. 20, 1958.
Isbell , D. E. , Non-planar logarithmically periodic antenna structures, Symposium on the USAF antenna research and development program, 7th , Oct. 21, 1957.
Ishikawa , Y. ; Hattori , J. ; Andoh , M. et al. , 800 MHz High Power Bandpass Filter Using TM Dual Mode Dielectric Resonators , European Microwave Conference , 21th , Sep. 9, 1991 , vol. 2.
Jaggard , D. , Diffraction by Bandlimited Fractal Screens , Optical Society AM , Jun. 1, 1987 , vol. 4 , No. 6.
Jaggard , D. L. , Fractal electrodynamics and modeling , Directions in electromagnetic wave modeling , Jan. 1, 1991 , pp. 435-446.
James , J. R. ; Hall , P. S. , Handbook of microstrip antennas , Peter Peregrinus Ltd. , Jan. 1, 1989 , vol. 1 , pp. 3-4 , 205-207.
Johnson , R. C. , Antenna engineering handbook—Table of contents, McGraw-Hill , Jan. 1, 1993.
Jones , H. S. , Conformal and Small antenna designs , Proceedings of the Antennas Applications Symposium , Aug. 1, 1981.
Kobayashi , K. , Estimation of 3D fractal dimension of real electrical tree patterns , Proceedings of the 4th International Conference on Properties and Applications of Dielectric Materials , Jul. 1, 1994.
Kraus , John D. , Antennas—Chapter 2 , McGraw-Hill Book Company , Jan. 1, 1988 , pp. 17-19 , 723-749.
Kritikos , H.N. ; Jaggard , D.L. , Recent advances in electromagnetic theory—Chapter 6 on fractal electrodynamics , Springer- Verlag , Oct. 1, 1990 , Chapter 6.
Kuhlman , E. A. , A directional flush mounted UHF communications antenna for high performance jet aircraft for the 225-400 MC frequency range , Symposium on The USAF Antenna Research and Development Program, 5th , Oct. 1, 1955.
Kumar , G. ; Gupta , K. , Nonradiating edges and four edges gap-coupled multiple resonator broadband microstrip antennas , Antennas and Propagation, IEEE Transactions on , Feb. 1, 1985.
Kumar , G. ; Gupta , K. , Directly coupled multiple resonator wide-band microstrip antennas , IEEE Transactions on Antennas and Propagation , Jun. 6, 1985 , AP-33.

(56) References Cited

OTHER PUBLICATIONS

Kuo , Sam , Frequency-independent log-periodic antenna arrays with increased directivity and gain , Symposium on USAF Antenna Research and Development, 21th Annual , Oct. 12, 1971.
Kurpis , G. P. , The New IEEE standard dictionary of electrical and electronics terms , IEEE Standards , Jan. 1, 1993 , pp. 90, 352, 393.
Kutter , R. E. , Fractal antenna design , University of Dayton , Jan. 1, 1996.
Kyriacos , S. ; Buczkowski , S. et al. , A modified box-counting method , Fractals—World Scientific Publishing Company , Jan. 1, 1994 , vol. 2 , No. 2 , pp. 321-324.
Lancaster , M. J. et al. , Miniature superconducting filters , Microwave Theory and Techniques, IEEE Transactions on , Jul. 1, 1996.
Larson , J. , A BAW Antenna Duplexer for the 1900 MHz PCS Band, IEEE Ultrasonics Symposium , Oct. 17, 1999.
Lee, J. C. , Analysis of differential line lenght diplexers and long-stub filters , Symposium on the USAF Antenna Research and Development, 23th , Oct. 12, 1971.
Liu , D. , A multi-branch monopole antenna for dual-band cellular applications , IEEE Antennas and Propagation Society International Symposium , Sep. 3, 1999 , vol. 3.
Liu , Zi Dong ; Hall , Peter S. ; Wake , David , Dual-frequency planar inverted-f antenna , Antennas and Propagation, IEEE Transactions on, Oct. 1, 1997.
Lo , Y. T. ; Solomon , D. ; Richards , W. F. , Theory and experiment on microstrip antennas , Antenna Applications Symposium , Sep. 20, 1978.
Locus , Stanley S. , Antenna design for high performance missile environment , Symposium on the USAF Antenna Research and Development Program, 5th , Oct. 16, 1955.
Lu , J. H. ; Wong , K. L. , Single-feed dual-frequency equilateral-triangular microstrip antenna with pair of spur lines , Electronic Letters , Jun. 11, 1998 , vol. 34.
Lu , J. H. ; Wong , K. L. , Dual-frequency rectangular microstrip antenna with embedded spur lines and integrated reactive loading , Microwave and Optical Technology Letters , May 20, 1999 , vol. 21.
Lu , J.H. ; Tang , C. L. ; Wong , K. L. , Novel dual-frequency and broad-band designs of slot-loaded equilateral triangular microstrip antennas , IEEE Transactions on Antennas and Propagation , Jul. 1, 2000 , vol. 48.
Lu , Jui-Han , Single-feed dual-frequency rectangular microstrip antenna , Antennas and Propagation Society International Symposium, 2000. IEEE , Jul. 1, 2000.
Lu , Jui-Han ; Tang , Chia-Luan ; Wong , Kin-Lu , Single-feed slotted equilateral triangular microstrip antenna for circular polarization , Antennas and Propagation, IEEE Transactions on , Jul. 1, 1999.
Lu , Jui-Han et al. , Slot-loaded, Meandered Rectangular Microstrip Antenna With Compact Dualfrequency Operation , IEEE Electronics Letters , May 28, 1998 , vol. 34 , No. 11.
Lyon , J. ; Rassweiler , G. ; Chen , C. , Ferrite-loading effects on helical and spiral antennas , 15th Annual Symposium on the USAF antenna reserach and development program , Oct. 12, 1965.
Maci , S. et al. , Dual-band Slot-loaded patch antenna , IEE Proceedings Microwave Antennas Propagation , Jun. 1, 1995 , vol. 142 , pp. 225-232.
Maci , S. et al. , Dual-frequency patch antennas , Antennas and Propagation Magazine, IEEE , Dec. 1, 1997.
Mandelbrot , B. B. , Opinions (Benoit B. Mandelbrot) , World Scientific Publishing Company , Jan. 1, 1993.
Mandelbrot, B. B. , The fractal geometry of nature , Freeman and Company , Jan. 1, 1982 , pp. 32-35.
Manteuffel , Dirk et al , Design considerations for integrated mobile phone antennas , IEEE Antennas and Propagation, 2001. Eleventh International Conference on (IEE Conf. Publ. No. 480) , Apr. 17, 2001.
Martin , R. W. ; Stangel , J. J. , An unfurlable, high-gain log-periodic antenna for space use , Symposium on the USAF Antenna Research and Development Program , Nov. 14, 1967.
Martin, W. R. , Flush vor antenna for c-121 aircraft , Symposium on The USAF Antenna Research and Development Program, 2nd , Oct. 19, 1952.
Matthaei , George L. , Microwave filters impedance-matching networks and coupling structures , Artech House , Jan. 1, 1980 , p. 1096.
Matthaei , George L. et al. , Hairpin-comb filters for HTS and other narrow-band applications , Microwave Theory and Techniques, IEEE Transactions on , Aug. 1, 1997 , vol. 45 , No. 3.
May , M. , Aerial magic , New Scientist , Jan. 31, 1998.
Mayes , P. , Some broadband , low-profile antennas , Antenna Applications Symposium , Sep. 18, 1985.
Mayes , P. E. , High gain log-periodic antennas , Symposium on the USAF antenna research and development program, 10th , Oct. 3, 1960.
Mayes , P.E. , Multi-arm logarithmic spiral antennas , Symposium on The USAF Antenna Research and Development Program, 10th , Oct. 3, 1960.
McCormick , J. , A Low-profile electrically small VHF antenna , 15th Annual Symposium on the USAF antenna reserach and development program , Oct. 12, 1965.
Deschamps , G. , Microstrip Microwave Antenna , Symposium on the USAF Antenna Research and Development Program , Oct. 18, 1953.
Dickstein , Harold D. , Antenna system for a ground passive electronic reconnaissance facility , Symposium on the USAF Antenna Research and Development Program , Oct. 20, 1958.
Dou , W. , Small broadband stacked planar monopole , Wiley InterScience , Nov. 20, 2000.
Du Plessis , M. ; Cloete , J. H. , Tuning stubs for microstrip patch antennas , AP-S. Digest Antennas and Propagation Society International Symposium , Jun. 28, 1993 , vol. 2 , pp. 964-967.
Dubost , G. , Wideband flat dipole and short-circuit microstrip patch elements and arrays. In Handbook of microstrip antennas—Chapter 7 , Peter Peregrinus Ltd. James , J. R. ; Hall , P. S. (ed.) , Jan. 1, 1989, vol. 1 , pp. 354-359.
DuHamel , R. H. , Broadband logarithmically periodic antenna structures , IRE International Convention Record , Mar. 14, 1957 , vol. 5, pp. 119-128.
DuHamel , R. H. ; Scherer , J. P. , Antenna engineering handbook—Chapter 14—Frequency-Independent Antennas , Johnson , R. McGraw-Hill (3rd. edition) , Jan. 1, 1993 , pp. 14-1-14-5.
Dyson , J. D. , The non-planar equiangular spiral antenna , Symposium on the USAF Antenna Research and Development Program , Oct. 20, 1958.
Dyson , J. D. , The equiangular spiral antenna , Antennas and Propagation, IRE Transactions on , Apr. 1, 1959.
Ellis , A. R. , Airborne UHF antenna pattern improvements , Symposium on the USAF antenna research and development program, 3rd , Oct. 18, 1953.
Esteban , J. ; Rebollar , J. M. , Design and optimization of a compact Ka-Band antenna diplexer , AP-S. Digest Antennas and Propagation Society International Symposium , Jun. 18, 1995.
Ewing , A , Letter and Engineering Test Report of FCC ID: GMLNPW-3 , Test and Certification Center—TCC , Dec. 19, 2001.
Falconer , K. , Fractal geometry _Full , John Wiley Sons—2nd ed. , Jan. 1, 2003.
Feder, J. , Fractals , Plenum Press , Jan. 1, 1988 , pp. 10-11, 15-17, and 25.
Feng , J. , Fractional box-counting approach to fractal dimension estimation , Pattern Recognition, 1996., Proceedings of the 13th International Conference on , Jan. 1, 1996.
Fenwick , R. C. , A new dass of electrically small antennas , Antennas and Propagation, IEEE Transactions on , May 1, 1965.
Ferris , J. E. , A status report of an Azimuth and elevation direction finder , Symposium on the USAF Antenna Research and Development Program , Oct. 15, 1968.
Fleishmann , M. ; Tildesley , DJ ; Balls , RC , Fractals in the natural sciences , Royal Society of London , Jan. 1, 1999.
Flom , M. , Letter to FCC—Communication of replacing employee , M. Flom Associates , May 23, 2000.
Flom , M. , Letter to FCC—Nokia SAR Information , M. Flom Associates—MFA , May 19, 2000.

(56) References Cited

OTHER PUBLICATIONS

Flom , M. , Letter to FCC—Application form 731 and Engineering Test Report by Nokia Mobile Phones for FCC ID: LJPNPW-1NB , M. Flom Associates—MFA , Mar. 12, 2001.
Flom , M. , Letter to modify the Emission Designator , M. Flom Associates—MFA , Mar. 30, 2001.
Force , R. et al. , Synthesis of multilayer walls for radomes of aerospace vehicles , Symposium on the USAF Antenna Research and Development Program , Nov. 14, 1967.
Foroutan-pour , K. ; Dutilleul , P. ; Smith , D.L. , Advances in the implementation of the box-counting method of fractal dimension estimation , Applied Mathematics and Computation ; Elsevier , May 1, 1999 , vol. 105 , pp. 195-210.
Garg , R. et al. , Microstrip antenna design handbook , Artech House, Jan. 1, 2001 , p. 845.
Gianvittorio , John Paul et al. , Fractal antennas—a novel antenna miniturization technique and applications , Antennas and Propagation Magazine, IEEE , Feb. 1, 2002.
Gilbert , R. ; Pirrung , A. ; Kopf , D. et al. , Structurally-integrated optically-reconfigurable antenna array , Antenna Applications Symposium , Sep. 20, 1995.
Gillespie , E. S. , Glide slope antenna in the nose radome of the F-104 A and B , Symposium on the USAF antenna research and development program, 7th , Oct. 21, 1957.
Graf, R , Modern dictionary of electronics , Butterworth-Heinemann (6th Ed.) , Jan. 1, 1984 , pp. 209, 644.
Graff , B. , Form 731 Corrections: GMLNSW-4DX , M. Flom Associates—MFA , Apr. 24, 2000.
Graff , W. , Letter to FCC—Test Report GMLNSW-4DX , M. Flom Associates—MFA , Mar. 17, 2000.
Gray , D. ; Lu , J. W. ; Thiel , D. V. , Electronically steerable Yagi-Uda microstrip patch antenna array , IEEE Transactions on antennas and propagation , May 1, 1998 , vol. 46.
Greiser , J. W. and Brown , G. S. , A 500:1 scale model of warla : A wide aperture radio location array , Symposium on the USAF Antenna Research and Development Program, 13th , Oct. 14, 1963.
Guo , Y. X. ; Luk , K. F. Lee ; Chow , Y. L. , Double U-slot rectangular patch antenna , Electronic Letters , Sep. 17, 1998.
Gupta , K. C. ; Benalla , A. , Microstrip antenna design , Artech House, Jan. 1, 1988.
Gupta , K.C. , Broadbanding techniques for microstrip patch antennas—a review , Antenna Applications Sysmposium , Sep. 21, 1988.
Hagström , P. , Novel ceramic antenna filters for GSM / DECT and GSM / PCN network terminals , The 8th IEEE International Symposium on Personal, Indoor and Mobile Radio Communications, 1997.
'Waves of the Year 2000'. PIMRC '97 , Sep. 1, 1997.
Halloran , T. W. , A dual channel VHF telemetry antenna system for re-entry vehide applications , Symposium on the USAF Antenna Research and Development Program, 11th , Oct. 16, 1961.
Hansen , R. C. , Fundamental limitations in antennas , IEEE Proceedings , Feb. 1, 1981 , vol. 69 , No. 2 , pp. 170-182.
Henderson West , B , The Prentice-Hall encydopedia of mathematics, Prentice-Hall , Jan. 1, 1982 , pp. 404-425.
Hikita , M. ; Shibagaki , N. ; Asal , K. et al , New miniature saw antenna duplexer used in GHz-band digital mobile cellular radios , IEEE Ultrasonics Symposium , Nov. 7, 1995.
Hikita , M. et al , Miniature SAW antenna duplexer for 800-Mhz portable telephone used in cellular radio systems , Microwave Theory and Techniques, IEEE Transactions on , Jun. 1, 1988.
Hill , J. E. ; Bass , J. F. , An integrated strip-transmission-line antenna system for J-band , Symposium on the USAF Antenna Research and Development Program, 23th , Oct. 10, 1973.
Hofer , D. A. ; Kesler , Dr. O. B. ; Loyet , L. L. , A compact multi-polarized broadband antenna , Proceedings of the 1989 antenna applications symposium , Sep. 20, 1989.
Hohlfeld , R. G. ; Cohen N. , Self-similarity and the geometric requirements for frequency independence in antennae , Fractals , Jan. 17, 1999 , vol. 7 , No. 1 , pp. 79-84.
Holtum , A. G. , A dual frequency dual polarized microwave antenna , Symposium on the USAF Antenna Research and Development Program, 16 , Oct. 11, 1966.
Holzschuh , D. L. , Hardened antennas for atlas and titan missile site communications , Symposium on the USAF Antenna Research and Development Program, 13th , Oct. 14, 1963.
Hong , J. S. ; Lancaster , M. J. , Recent advances in microstrip filters for communications and other applications , IEE Colloquium on Advances in Passive Microwave Components (Digest No. 1997/154), May 22, 1997.
Hong , J. S. ; Lancaster , M. J. , Compact microwave elliptic function filter using novel microstrip meander open-loop resonators , Electronic Letters , Mar. 14, 1996 , vol. 32 , , pp. 563-564.
Huynh , T. ; Lee , K. F. , Single-layer single-patch wideband microstrip antenna , Electronic Letters , Aug. 3, 1995 , vol. 31.
U.S. Appl. No. 10/422,578—Office Action dated on Apr. 7, 2005, USPTO.
U.S. Appl. No. 10/422,578—Office Action dated on Aug. 23, 2007, USPTO.
U.S. Appl. No. 10/422,578—Office Action dated on Aug. 24, 2005, USPTO.
U.S. Appl. No. 10/422,578—Office Action dated on Jan. 26, 2006, USPTO.
U.S. Appl. No. 10/422,578—Office Action dated on Jun. 23, 2005, USPTO.
U.S. Appl. No. 10/422,578—Office Action dated on Mar. 12, 2007, USPTO.
U.S. Appl. No. 10/422,578—Office action dated on Mar. 26, 2008, USPTO.
U.S. Appl. No. 10/422,578—Office Action dated on Oct. 4, 2004, USPTO.
U.S. Appl. No. 10/422,578—Request for Continued Examination with response to the office action dated on Apr. 7, 2005 and the advisory action dated on Jun. 23, 2005, Jones Day, Aug. 8, 2005.
U.S. Appl. No. 10/422,578—Response to the Office Action dated on Apr. 7, 2005, Jones Day, May 31, 2005.
U.S. Appl. No. 10/422,578—Response to the Office Action dated on Oct. 4, 2004, Jones Day, Jan. 6, 2005.
U.S. Appl. No. 10/422,578—Response to the Office Action mailed on Jan. 26, 2006 and Advisory Action mailed on Mar. 29, 2006, Jones Day, May 1, 2006.
U.S. Appl. No. 10/822,933—Notice of allowance dated on Oct. 18, 2007, USPTO.
U.S. Appl. No. 10/822,933—Office Action dated on Oct. 5, 2006, USPTO.
U.S. Appl. No. 10/822,933—Response to Office Action dated on Oct. 5, 2006, Jenkens & Gilchrist, Jan. 4, 2007.
U.S. Appl. No. 10/963,080—Notice of allowance dated on Sep. 1, 2005., USPTO.
U.S. Appl. No. 10/963,080—Preliminary amendment—Declaration of J. Baxter—Exhibit W, Jones Day. Case 6:09-cv-00203-LED-JDL, Dec. 10, 2004.
U.S. Appl. No. 11/021,597—Office action dated Oct. 30, 2007, USPTO.
U.S. Appl. No. 11/021,597—Office Action dated on Mar. 12, 2007, USPTO.
U.S. Appl. No. 11/021,597—Response to the Office Action dated Mar. 12, 2007, Winstead, Aug. 9, 2007.
U.S. 11/021,597—Response to the office action dated Oct. 30, 2007, Winstead, Dec. 28, 2007.
U.S. Appl. No. 11/033,788—Response to Office Action dated Feb. 7, 2006, Jenkens & Gilchrist, Jun. 1, 2006.
U.S. Appl. No. 11/102,390—Notice of allowance dated on Jul. 6, 2006., USPTO, Jun. 25, 2006.
U.S. Appl. No. 11/110,052—Notice of Allowance dated on May 30, 2006, USPTO.
U.S. Appl. No. 11/124,768—Amendment in response to non-final office action dated Aug. 23, 2006, Jenkens & Gilchrist, Nov. 13, 2006.
U.S. Appl. No. 11/124,768—Amendment in response to non-final office action dated on Dec. 28, 2007, Winstead PC, Feb. 1, 2008.
U.S. Appl. No. 11/124,768—Amendment in response to the office action dated Feb. 21, 2007, Winstead PC, Jun. 7, 2007.

(56) References Cited

OTHER PUBLICATIONS

U.S. Appl. No. 11/124,768—Notice of Allowance dated on Apr. 7, 2008, USPTO.
U.S. Appl. No. 11/124,768—Notice of Allowance dated on Aug. 29, 2007, USPTO, Aug. 20, 2007.
U.S. Appl. No. 11/124,768—Notice of Allowance dated on May 13, 2006, USPTO.
U.S. Appl. No. 11/124,768—Office Action dated on Aug. 23, 2006, USPTO.
U.S. Appl. No. 11/124,768—Office Action dated on Dec. 28, 2007, USPTO.
U.S. Appl. No. 11/124,768—Office Action dated on Feb. 21, 2007., USPTO.
U.S. Appl. No. 11/179,250—Response office action, Howison & Arnott—Case 6:09-cv-00203-LED-JDL, Jul. 12, 2005.
U.S. Appl. No. 11/179,257—Notice of allowance dated on Oct. 19, 2006, USPTO.
U.S. Appl. No. 11/550,256—Office Action dated on Jan. 15, 2008, USPTO.
U.S. Appl. No. 11/713,324—Amendment in response to non-final office action dated on Feb. 6, 2008, Winstead PC, Mar. 17, 2008.
U.S. Appl. No. 11/713,324—Notice of Allowance dated on May 14, 2008, USPTO.
U.S. Appl. No. 11/713,324—Office Action dated on Feb. 6, 2008, USPTO, Feb. 12, 2008.
U.S. Appl. No. 11/780,932—Preliminary amendment dated on Jul. 20, 2007, Howison & Arnott.
U.S. Appl. No. 12/055,748—Amendment in response to non-final office action dated on Oct. 1, 2008, Winstead PC, Mar. 2, 2009.
U.S. Appl. No. 12/055,748—Notice of Allowance dated on Aug. 12, 2009, USPTO.
U.S. Appl. No. 12/055,748—Notice of Allowance dated on Nov. 20, 2009, USPTO.
U.S. Appl. No. 12/055,748—Office Action dated on May 28, 2009, USPTO, Jun. 3, 2009.
U.S. Appl. No. 12/055, 748—Office Action dated on Oct. 1, 2008., USPTO, Oct. 6, 2008.
U.S. Appl. No. 12/055,748—Response to the Office Action dated on May 28, 2009, Winstead PC, Jun. 26, 2009.
U.S. Appl. No. 12/347,462—Notice of Allowance dated on May 18, 2009, USPTO.
U.S. Appl. No. 12/347,462—Office Action dated on Oct. 28, 2009, USPTO.
U.S. Appl. No. 12/652,794—Office Action dated on Jun. 23, 2010, USPTO, Jun. 29, 2010.
U.S. Appl. No. 12/652,974—Notice of allowance dated May 21, 2012, USPTO.
Infringement Chart—Samsung SGH A117, Fractus, Nov. 5, 2009.
Infringement Chart—Samsung SGH A117. Patent: 7,411,556, Fractus, Nov. 5, 2009.
Infringement Chart—Samsung SGH A437, Fractus, Nov. 5, 2009.
Infringement Chart—Samsung SGH A867, Fractus, Nov. 5, 2009.
Infringement Chart—Samsung SGH A867. Patent: 7,411,556, Fractus, Nov. 5, 2009.
Infringement Chart—Samsung SGH T229, Fractus, Nov. 5, 2009.
Infringement Chart—Samsung SGH T229. Patent: 7,411,556, Fractus, Nov. 5, 2009.
Infringement Chart—Samsung SGH T439, Fractus, Nov. 5, 2009.
Infringement Chart—Samsung SGH T439. Patent: 7,411,556, Fractus, Nov. 5, 2009.
Infringement Chart—Samsung SGH T919, Fractus, Nov. 5, 2009.
Infringement Chart—Samsung SGH T919. Patent: 7,411,556, Fractus, Nov. 5, 2009.
Infringement Chart—Samsung SGH-A237, Fractus, Nov. 5, 2009.
Infringement Chart—Samsung SGH-A237. Patent: 7,411,556, Fractus, Nov. 5, 2009.
Infringement Chart—Samsung SGH-A257, Fractus, Nov. 5, 2009.
Infringement Chart—Samsung SGH-A257. Patent: 7,411,556, Fractus, Nov. 5, 2009.
Infringement Chart—Samsung SGH-A437. Patent: 7,411,556, Fractus, Nov. 5, 2009.
Infringement Chart—Samsung SGH-A837, Fractus, Nov. 5, 2009.
Infringement Chart—Samsung SGH-A837. Patent: 7,411,556, Fractus, Nov. 5, 2009.
Infringement Chart—Samsung SGH-T219., Fractus, Nov. 5, 2009.
Infringement Chart—Samsung SGH-T219. Patent: 7,411,556, Fractus, Nov. 5, 2009.
Infringement Chart—Samsung SGH-T559, Fractus, Nov. 5, 2009.
Infringement Chart—Samsung SGH-T559. Patent: 7,411,556, Fractus, Nov. 5, 2009.
Infringement Chart—Samsung SGH-T639, Fractus, Nov. 5, 2009.
Infringement Chart—Samsung SGH-T639. Patent: 7,411,556, Fractus, Nov. 5, 2009.
Infringement Chart—Samsung SGH-T929, Fractus, Nov. 5, 2009.
Infringement Chart—Samsung SGH-T929. Patent: 7,411,556, Fractus, Nov. 5, 2009.
Infringement Chart—Samsung SPH-M550, Fractus, Nov. 5, 2009.
Infringement Chart—Samsung SPH-M550. Patent: 7,411,556, Fractus, Nov. 5, 2009.
Infringement Chart—Sanyo Katana II., Fractus, Nov. 5, 2009.
Infringement Chart—Sanyo Katana LX, Fractus, Nov. 5, 2009.
Infringement Chart—Sanyo Katana LX. Patent: 7,411,556, Fractus, Nov. 5, 2009.
Infringement Chart—Sanyo Katanna II. Patent: 7,411,556, Fractus, Nov. 5, 2009.
Infringement Chart—Sharp Sidekick LX. Patent: 7,411,556, Fractus, Nov. 5, 2009.
Infringement Chart—UTStarcom CDM7126., Fractus, Nov. 5, 2009.
Infringement Chart—UTStarcom CDM7126. Patent: 7,411,556, Fractus, Nov. 5, 2009.
U.S. Appl. No. 10/102,568—Amendment and response to the Office Action dated on Jan. 23, 2004, Jones Day, May 26, 2004.
U.S. Appl. No. 10/102,568—Office Action dated on Jan. 23, 2004, USPTO.
U.S. Appl. No. 10/102,568—Preliminary Amendment—Exhibit CCCC, Rosenman & Colin LLP, Mar. 18, 2002.
U.S. Appl. No. 10/181,790—Office action dated on Aug. 27, 2004, USPTO.
U.S. Appl. No. 10/181,790—Office action dated on Aug. 4, 2005, USPTO.
U.S. Appl. No. 10/181,790—Office action dated on Jun. 2, 2005, USPTO.
U.S. Appl. No. 10/181,790—Office action dated on Mar. 2, 2005, USPTO.
U.S. Appl. No. 10/181,790—Response to office action dated on Aug. 27, 2004, Jones Day, Dec. 8, 2004.
U.S. Appl. No. 10/181,790—Response to the office action dated on Jun. 2, 2005, Jones Day, Jul. 20, 2005.
U.S. Appl. No. 10/181,790—Response to the office action dated on Mar. 2, 2005, Jones Day, Mar. 14, 2005.
U.S. Appl. No. 10/182,635—Amendment and response to office action dated on Dec. 13, 2004, Jones Day, Mar. 17, 2005.
U.S. Appl. No. 10/182,635—Amendment and response to office action dated on Oct. 4, 2004, Jones Day, Nov. 12, 2004.
U.S. Appl. No. 10/182,635—Notice of Allowance dated on Apr. 11, 2005, USPTO.
U.S. Appl. No. 10/182,635—Office Action dated on Dec. 13, 2004, USPTO.
U.S. Appl. No. 10/422,578—Advisory Action before the filing of an Appeal Brief, USPTO, Jun. 23, 2005.
Infringement Chart—LG VX8350, Fractus, Nov. 5, 2009.
Infringement Chart—LG VX8350. Patent: 7,411,556, Fractus, Nov. 5, 2009.
Infringement Chart—LG VX8360., Fractus, Nov. 5, 2009.
Infringement Chart—LG VX8360. Patent: 7,411,556, Fractus, Nov. 5, 2009.
Infringement Chart—LG VX8560 Chocolate 3, Fractus, Nov. 5, 2009.
Infringement Chart—LG VX8560 Chocolate 3. Patent: 7,411,556, Fractus, Nov. 5, 2009.
Infringement Chart—LG VX9400, Fractus, Nov. 5, 2009.

(56) References Cited

OTHER PUBLICATIONS

Infringement Chart—LG VX9400. Patent: 7,411,556, Fractus, Nov. 5, 2009.
Infringement Chart—Pantech Breeze C520., Fractus, Nov. 5, 2009.
Infringement Chart—Pantech Breeze C520. Patent: 7,411,556, Fractus, Nov. 5, 2009.
Infringement Chart—Pantech DUO C810., Fractus, Nov. 5, 2009.
Infringement Chart—Patench DUO C810. Patent: 7,411,556, Fractus, Nov. 5, 2009.
Infringement Chart—RIM Blackberry 8110, Fractus, Nov. 5, 2009.
Infringement Chart—RIM Blackberry 8120, Fractus, Nov. 5, 2009.
Infringement Chart—RIM Blackberry 8130, Fractus, Nov. 5, 2009.
Infringement Chart—Rim Blackberry 8220, Fractus, Nov. 5, 2009.
Infringement Chart—RIM Blackberry 8310, Fractus, Nov. 5, 2009.
Infringement Chart—RIM Blackberry 8320, Fractus, Nov. 5, 2009.
Infringement Chart—RIM Blackberry 8330, Fractus, Nov. 5, 2009.
Infringement Chart—RIM Blackberry 8820, Fractus, Nov. 5, 2009.
Infringement Chart—RIM Blackberry 8830, Fractus, Nov. 5, 2009.
Infringement Chart—RIM Blackberry Pearl 8100, Fractus, Nov. 5, 2009.
Infringement Chart—Samsung FlipShot SCH-U900, Fractus, Nov. 5, 2009.
Infringement Chart—Samsung FlipShot SCH-U900. Patent: 7,411,556, Fractus, Nov. 5, 2009.
Infringement Chart—Samsung M320, Fractus, Nov. 5, 2009.
Infringement Chart—Samsung M320. Patent: 7,411,556, Fractus, Nov. 5, 2009.
Infringement Chart—Samsung SCH A127., Fractus, Nov. 5, 2009.
Infringement Chart—Samsung SCH A127. Patent: 7,411,556, Fractus, Nov. 5, 2009.
Infringement Chart—Samsung SCH U340., Fractus, Nov. 5, 2009.
Infringement Chart—Samsung SCH U340. Patent: 7,411,556, Fractus, Nov. 5, 2009.
Infringement Chart—Samsung SCH U410., Fractus, Nov. 5, 2009.
Infringement Chart—Samsung SCH U410. Patent: 7,411,556, Fractus, Nov. 5, 2009.
Infringement Chart—Samsung SCH U700, Fractus, Nov. 5, 2009.
Infringement Chart—Samsung SCH U700. Patent: 7,411,556, Fractus, Nov. 5, 2009.
Infringement Chart—Samsung SCH-A645, Fractus, Nov. 5, 2009.
Infringement Chart—Samsung SCH-A645. Patent: 7,411,556, Fractus, Nov. 5, 2009.
Infringement Chart—Samsung SCH-R430, Fractus, Nov. 5, 2009.
Infringement Chart—Samsung SCH-R430. Patent: 7,411,556, Fractus, Nov. 5, 2009.
Infringement Chart—Samsung SCH-R500., Fractus, Nov. 5, 2009.
Infringement Chart—Samsung SCH-R500. Patent: 7,411,556, Fractus, Nov. 5, 2009.
Infringement Chart—Samsung SCH-R600, Fractus, Nov. 5, 2009.
Infringement Chart—Samsung SCH-R600. Patent: 7,411,556, Fractus, Nov. 5, 2009.
Infringement Chart—Samsung SCH-U310, Fractus, Nov. 5, 2009.
Infringement Chart—Samsung SCH-U310. Patent: 7,411,556, Fractus, Nov. 5, 2009.
Infringement Chart—Samsung SCH-U520, Fractus, Nov. 5, 2009.
Infringement Chart—Samsung SCH-U520. Patent: 7,411,556, Fractus, Nov. 5, 2009.
Infringement Chart—Samsung SCH-U750, Fractus, Nov. 5, 2009.
Infringement Chart—Samsung SCH-U750. Patent: 7,411,556, Fractus, Nov. 5, 2009.
Infringement Chart—Samsung SCH-U940, Fractus, Nov. 5, 2009.
Infringement Chart—Samsung SCH-U940. Patent: 7,411,556, Fractus, Nov. 5, 2009.
Document 0843—Joint Motion to Dismiss Claims and Counterclaims re '850 and '822, Defendants, Apr. 15, 2011.
Document 0854—Defendants' Motion to Clarify Claim Construction, Defendants, Apr. 18, 2011.
Document 0868—Order, Court, Apr. 19, 2011.
Document 0876—Fractus's surreply to defendants' Motion for Summary Judgment re publication dates of three references, Susman Godfrey, Apr. 20, 2011.
Document 0887—Fractus's Response to Defendants' Motion to Clarify Claim Construction, Susman Godfrey, Apr. 25, 2011.
Document 0889—Reply in support of defendants' motion to clarify claim construction, Defendants, Apr. 27, 2011.
Document 0893—Fractus SA's surreply to defendant's motion to clarify claim construction, Susman Godfrey, Apr. 29, 2011.
Document 0900—Order, Court, Apr. 29, 2011.
Document 0901—Report and recommendation of United States Magistrate Judge, Court, May 5, 2011.
Document 0902—Fractus SA's objections to defendants' prior art notice, Susman Godfrey, May 2, 2011.
Document 0915—Defendants' response to plaintiffs objections to defendants notice of prior art, Defendants, May 5, 2011.
Document 0933—Defendants' motion for reconsideration of, and objections to, the May 2, 2011 report and recommendation clarifying claim construction, Defendants, May 9, 2011.
Document 0939—Fractus's response to defendants' motion for reconsideration of and objections to the May 2, 2011, report and recommendations clarifying claim construction, Susman Godfrey, May 10, 2011.
Document 0968—Order, Court, May 13, 2011.
Document 0971—Order, Court, May 13, 2011.
Document 1082—Joint motion to dismiss HTC, Susman Godfrey LLP, Sep. 13, 2011.
Document 1083—Order—Final consent judgement HTC, Court, Sep. 15, 2011.
Document 1088—Samsung's motion to determine intervening rights in view of new Federal Circuit case law or, in the alternative, to stay the case pending the outcome of reexamination, Defendants, Oct. 19, 2011.
Document 1091—Fractus's response to Samsung's motion to determine intervening rights or to stay the case pending the outcome of reexamination, Susman Godfrey LLC, Nov. 2, 2011.
Document 1092—Samsung's reply in support of its motion to determine intervening rights in view of new Federal Circuit case law or, in the alternative, to stay the case pending the outcome of reexamination, Defendants, Nov. 14, 2011.
Defendants Invalidity contentions including appendix and exhibits regarding the US patent 7,411,556 Multiband Monopoles, Defendants, Feb. 8, 2010.
Fractus' Claim Construction Presentation—Markman Hearing, Fractus, Sep. 2, 2010.
Claim construction and motion for summary judgement—Markman Hearing —[Defendants], Defendants, Sep. 2, 2010.
Document 1—Original complaint for patent infringement—Downunder wireless, Downunder Wireless LLC, Jun. 29, 2009.
Expert report of Dr. Warren L. Stutzman (redacted)—expert witness retained by Fractus, Fractus, Feb. 23, 2011.
Expert report of Dwight L. Jaggard (redacted)—expert witness retained by Fractus, Fractus, Feb. 23, 2011.
Expert report of Stuart Long (redacted)—expert witness retained by Fractus, Fractus, Feb. 23, 2011.
Rebuttal expert report of Dr. Dwight L. Jaggard (redacted version), Fractus, Feb. 16, 2011.
Rebuttal expert report of Dr. Stuart A. Long (redacted version), Fractus, Feb. 16, 2011.
Rebuttal expert report of Dr. Warren L. Stutzman (redacted version), Fractus, Feb. 16, 2011.
Demonstratives presented by Dr. Steven Best during trial, Defendants, May 19, 2011.
Demonstratives presented by Dr. Stuart Long during trial, Fractus, May 18, 2011.
Letter from Baker Botts to Howison & Arnott LLP induding exhibits, Defendants—Baker Botts, Aug. 5, 2010.
Letter from Baker Botts to Kenyon & Kenyon LLP, Winstead PC and Howison & Arnott LLP including exhibits., Defendants—Baker Botts, Oct. 28, 2009.
The oral and videotaped deposition of Dwight Jaggard. vol. 1, Defendants, Mar. 8, 2011.

(56) References Cited

OTHER PUBLICATIONS

The oral and videotaped deposition of Dwight Jaggard. vol. 2, Defendants, Mar. 9, 2011.
The oral and videotaped deposition of Dwight Jaggard. vol. 3, Defendants, Mar. 10, 2011.
Oral and videotaped deposition of Dr. Stuart Long—vol. 1, , Mar. 11, 2011.
Oral and videotaped deposition of Dr. Stuart Long—vol. 2, Fractus, Mar. 13, 2011.
Oral and videotaped deposition of Dr. Stuart Long—vol. 3, Fractus, Mar. 14, 2011.
Oral and videotaped deposition of Dr. Warren L. Stutzman—vol. 1, Fractus, Mar. 3, 2011.
Oral and videotaped deposition of Dr. Warren L. Stutzman—vol. 2, Fractus, Mar. 4, 2011.
Transcript of jury trial before the Honorable Leonard Davis—May 18, 2011—1:00 PM, Court, May 18, 2011.
Transcript of jury trial before the Honorable Leonard Davis—May 18, 2011—8:45 AM, Court, May 18, 2011.
Transcript of jury trial before the Honorable Leonard Davis—May 19, 2011—1:00 PM, Court.
Transcript of jury trial before the Honorable Leonard Davis—May 19, 2011—8:45 AM, Court.
Transcript of jury trial before the Honorable Leonard Davis—May 20, 2011—12:30 PM, Court.
Transcript of jury trial before the Honorable Leonard Davis—May 20, 2011—8:30 AM, Court.
Transcript of jury trial before the Honorable Leonard Davis—May 23, 2011—8:55 AM, Court.
Transcript of jury trial before the Honorable Leonard Davis US District Judge—May 17, 2011—8:00 AM, Court.
Adcock , M. D , New type feed for high speed conical scanning , Symposium on the USAF Antenna Research and Development Program, 2nd , Aug. 11, 1952.
Addison , P. S. , Fractals and Chaos—An illustrated course—Full , Institute of Physics Publising Bristol and Philadelphia , Jan. 1, 1997.
Ali , M. ; Hayes , G. J. et al , A triple band internal antenna for mobile handheld terminals , IEEE Antennas and Propagation Society International Symposium, Jun. 6, 2002.
Andersen , J. B. , The handbook of antenna design—Low- and medium-gain microwave antennas , Rudge , A. W. et al; IEE Eletromagnetic Waves Series; Peter Peregrinus Ltd. (2nd ed.) , Jan. 1, 1986 , vol. 1 and 2 , pp. 526-543.
Azadegan , R. ; Sarabandi , K. , Design of miniaturized slot antennas, IEEE Antennas and Propagation Society International Symposium, Jul. 8, 2001 , vol. 4 , pp. 565-568.
Bach Andersen , J. et al. , On closely coupled dipoles in a random field, Antennas and Wireless Propagation Letters, IEEE , Dec. 1, 2006, vol. 5.
Balanis , Constantine A. , Antenna theory—Analysis and Design—Chapter 9 / Chapter 14—Broadband dipoles and matching techniques / Microstrip antennas , Hamilton Printing , Jan. 1, 1982 , pp. 465-484 and 722-767.
Balanis , Constantine A. , Antenna Theory—Analysis and design—Chapter 10—Travelling wave and broadband antennas , Hamilton Printing , Jan. 1, 1982 , pp. 498-502.
Balanis, Constantine A. , Antenna theory—Analysis and design—Chapter 2—Fundamental parameters of antennas , John Wiley & Sons , Jan. 1, 1982 , pp. 28-100.
Barnsley , M. , Fractals Everywhere , Academic Press Professional , Jan. 1, 1993 , 2nd ed.
Barrick , W. , A helical resonator antenna diplexer , Symposium on the USAF antenna research and development program, 10th , Oct. 3, 1960.
Batson , D. D. et al , VHF unfurlable turnstile antennas , Symposium USAF antenna research and development program, 19th , Oct. 14, 1969.
Berizzi , F. , Fractal analysis of the signal scattered from the sea surface , Antennas and Propagation, IEEE Transactions on , Feb. 1, 1999 , vol. 47 , No. 2.
Best , Steven R. , The fractal loop antenna: a comparison of fractal and non-fractal geometries , Antennas and Propagation Society International Symposium, 2001. IEEE , Jan. 1, 2001.
Besthorn , 1.0 to 21.0 GHz Log-periodic dipole antenna , Symposium on the USAF Antenna Research and Development Program, 18th , Oct. 15, 1968.
Blackband , W. T. , The handbook of antenna design—Chapter 18—Coaxial transmisison lines and components , Rudge , A. W. et al.Peter Peregrinus , Jan. 1, 1986, vol. 1 and vol. 2 , pp. 1612-1623.
Blackband , W. T. , The handbook of antenna design—Chapter 18—Coaxial transmission lines and components , Rudge , A. W. et al—IEE Eletromagnetic Waves Series; Peter Peregrinus Ltd. , Jan. 1, 1986 , 2nd ed. , pp. 1612-1616.
Bokhari , S. A. ; Zürcher , J.-F. ; Mosig , Juan R. et al , A small microstrip patch antenna with a convenient tuning option , Antennas and Propagation, IEEE Transactions on , Nov. 1, 1996.
Borja , C. , Fractal microstrip antennas : Antenas fractales microstrip, Universitat Politecnica de Catalunya , Jul. 1, 1997.
Borja , C. , Panel 01 , Fractus—Telefonica , Jan. 1, 1998.
Borja , C. , MSPK product , Fractus—Telefonica , Jan. 1, 1998.
Borja , C. ; Puente , C. , Iterative network models to predict the performance of Sierpinski fractal antennas and networks , Antennas and Propagation Society International Symposium, 1999. IEEE , Jul. 11, 1999.
Borowski , E. J. , Dictionary of Mathematics , Collins , Jan. 1, 1989 , pp. 456-457.
Boshoff , H. , A fast box counting algorithm for determining the fractal dimension of sampled continuous functions , IEEE , Jan. 1, 1992.
Brown, A. , A high-performance integrated K-band diplexer , Transactions on Microwave Theory and Techniques , Aug. 8, 1999 , vol. 47.
Buczkowski , Stéphane ; Kyriacos , Soula ; Nekka , Fahima ; Cartilier, Louis , The modified box-countig method: analysis of some characteristic paramenters , Pattern Recognition—ElServier Science , Apr. 20, 1998 , vol. 31 , pp. 411-418(8).
Burnett , G. F. , Antenna installations on super constellation airbone early warning and control aircraft , Symposium on the USAF antenna research and development program, 4th , Oct. 17, 1954.
Bushman , F.W , The boeing B-52 all flush antenna system , Symposium on the USAF Antenna Reseach and Development Program, 5th, Oct. 16, 1955.
Campi , M. , Design of microstrip linear array antennas , Antenna Applications Symposium , Aug. 8, 1981.
Campos , O. , Multiband and miniature fractal antennas study : Estudi d'antenes fractal multibanda i en miniatura , Universitat Politecnica de Catalunya , Jan. 1, 1998.
Carver , K. R. et al. , Microstrip antenna technology , in "Microstrip antennas" to D.M. Pozar; IEEE Antennas and Propagation Society , Jan. 1, 1995 , pp. 3-26.
Carver , K. R. et al. , Microstrip antenna technology , Antennas and Propagation, IEEE Transactions on , Jan. 1, 1981 , AP29 , No. 1.
Caswell , W. E. , Invisible errors in dimensions calculations: geometric and systematic effects , Dimensions and Entropies in Chaotic Systems , Jan. 1, 1986 , pp. 123-136.
Chen , H. , Dual frequency microstrip antenna with embedded reactive loading , Microwave and Optical Technology Letters , Nov. 5, 1999 , vol. 23 , No. 3.
Chen , M.H. , A compact EHF/SHF dual frequency antenna , IEEE International Symposium on Antennas and Propagation , May 7, 1990 , vol. 4.
Chen , S. et al. , On the calculation of Fractal features from images , IEEE Transactions on Pattern Analysis and Machine Intelligence , Oct. 1, 1993 , vol. 15 , No. 10.
Chen , Wen-Shyang , Square-ring microstrip antenna with a cross strip for compact circular polarization operation , Antennas and Propagation, IEEE Transactions on , Oct. 1, 1999.
Chen , Z. N. , Broadband probe-fed L-shaped plate antenna , Microwave and Optical Technology Letters , Aug. 5, 2000 , vol. 26 , No. 3.
Chiba , N. et al , Dual frequency planar antenna for handsets , Electronic Letters , Dec. 10, 1998.
Cohen , N. , Fractal element antennas , Journal of Electronic Defense, Jul. 1, 1997.

(56) References Cited

OTHER PUBLICATIONS

Cohen, N. , Fractal antenna applications in wireless telecommunications , IEEE Electronic Industries Forum of New England. Professional Program Proceedings Boston , May 6, 1997 , pp. 43-49.
Cohen, N. , NEC4 analysis of a fractalized monofiliar helix in an axial mode , ACES Conference Procedings , Apr. 1, 1998 , p. 1051.
Cohn , S. B. , Flush airborne radar antennas , Symposium on the USAF antenna research and development program, 3rd , Oct. 18, 1953.
Collier , C. P. , Geometry for teachers , Waveland Press, Inc. , Jan. 1, 1984.
Collier , D. ; Shnitkin , H. , The monopole as a wideband array antenna element , Antenna Applications Symposium , Sep. 22, 1993.
Counter , V. A. , Flush, re-entrant, impedance phased, circularly polarized cavity antenna for missiles , Symposium on the USAF antenna research and development program, 2nd , Oct. 19, 1952.
Counter , V. A. ; Margerum , D. L. , Flush dielectric disc antenna for radar , Symposium on the USAF antenna research and development program, 2nd , Oct. 19, 1952.
Cristal , E. G. et al , Hairpin-line and hybrid hairpin-line / Half-wave parallel-coupled-line filers , Microwave Theory and Techniques, IEEE Transactions on , Nov. 1, 1972.
Daniel , A. E. ; Kumar , G. , Rectangular microstrip antennas with stub along the non-radiating edge for dual band operation , IEEE Antennas and Propagation Society International Symposium Digest, Jun. 18, 1995 , vol. 4 , pp. 2136-2139.
Deng , Sheng-Ming , A t-strip loaded rectangular microstrip patch antenna for dual-frequency operation , Antennas and Propagation Society International Symposium, 1999. IEEE , Jul. 1, 1999.
Transcript of jury trial before the Honorable Leonard Davis, US District Judge—May 17, 2011—1:10 PM, Court.
Transcript of pretrial hearing before the Honorable Leonard Davis, US District Judge—May 16, 2011—2:00 PM, Court.
Infringement Chart—Blackberry 8100. Patent: 7,411,556, Fractus, Nov. 5, 2009.
Infringement Chart—Blackberry 8110. Patent: 7,411,556, Fractus, Nov. 5, 2009.
Infringement Chart—Blackberry 8120. Patent: 7,411,556, Fractus, Nov. 5, 2009.
Infringement Chart—Blackberry 8130. Patent: 7,411,556, Fractus, Nov. 5, 2009.
Infringement Chart—Blackberry 8220. Patent: 7,411,556, Fractus, Nov. 5, 2009.
Infringement Chart—Blackberry 8310. Patent: 7,411,556, Fractus, Nov. 5, 2009.
Infringement Chart—Blackberry 8320. Patent: 7,411,556, Fractus, Nov. 5, 2009.
Infringement Chart—Blackberry 8330. Patent: 7,411,556, Fractus, Nov. 5, 2009.
Infringement Chart—Blackberry 8820. Patent: 7,411,556, Fractus, Nov. 5, 2009.
Infringement Chart—Blackberry 8830. Patent: 7,411,556, Fractus, Nov. 5, 2009.
Infringement Chart—Kyocera MARBL, Fractus, Nov. 5, 2009.
Infringement Chart—Kyocera MARBL. Patent: 7,411,556, Fractus, Nov. 5, 2009.
Infringement Chart—Kyocera NEO E1100, Fractus, Nov. 5, 2009.
Infringement Chart—Kyocera NEO E1100. Patent: 7,411,556, Fractus, Nov. 5, 2009.
Infringement Chart—Kyocera S2400, Fractus, Nov. 5, 2009.
Infringement Chart—Kyocera S2400. Patent: 7,411,556, Fractus, Nov. 5, 2009.
Infringement Chart—LG Aloha LX140., Fractus, Nov. 5, 2009.
Infringement Chart—LG Aloha LX140. Patent: 7,411,556, Fractus, Nov. 5, 2009.
Infringement Chart—LG AX155., Fractus, Nov. 5, 2009.
Infringement Chart—LG AX155. Patent: 7,411,556, Fractus, Nov. 5, 2009.
Infringement Chart—LG AX380, Fractus, Nov. 5, 2009.
Infringement Chart—LG AX380. Patent: 7,411,556, Fractus, Nov. 5, 2009.
Infringement Chart—LG AX8600, Fractus, Nov. 5, 2009.
Infringement Chart—LG AX8600. Patent: 7,411,556, Fractus, Nov. 5, 2009.
Infringement Chart—LG Chocolate VX8550, Fractus, Nov. 5, 2009.
Infringement Chart—LG Chocolate VX8550. Patent: 7,411,556, Fractus, Nov. 5, 2009.
Infringement Chart—LG enVTouch VX1100., Fractus, Nov. 5, 2009.
Infringement Chart—LG enVTouch VX1100. Patent: 7,411,556, Fractus, Nov. 5, 2009.
Infringement Chart—LG EnV3 VX9200., Fractus, Nov. 5, 2009.
Infringement Chart—LG EnV3 VX9200. Patent: 7,411,556, Fractus, Nov. 5, 2009.
Infringement Chart—LG Flare LX165, Fractus, Nov. 5, 2009.
Infringement Chart—LG Flare LX165. Patent: 7,411,556, Fractus, Nov. 5, 2009.
Infringement Chart—LG Lotus, Fractus, Nov. 5, 2009.
Infringement Chart—LG Lotus. Patent: 7,411,556, Fractus, Nov. 5, 2009.
Infringement Chart—LG MUZIQ LX570, Fractus, Nov. 5, 2009.
Infringement Chart—LG Muziq LX570. Patent: 7,411,556, Fractus, Nov. 5, 2009.
Infringement Chart—LG Rumor, Fractus, Nov. 5, 2009.
Infringement Chart—LG Rumor. Patent: 7,411,556, Fractus, Nov. 5, 2009.
Infringement Chart—LG Shine CU720, Fractus, Nov. 5, 2009.
Infringement Chart—LG Shine CU720. Patent: 7,411,556, Fractus, Nov. 5, 2009.
Infringement Chart—LG Voyager VX10000, Fractus, Nov. 5, 2009.
Infringement Chart—LG Voyager VX10000. Patent: 7,411,556, Fractus, Nov. 5, 2009.
Infringement Chart—LG VU CU920, Fractus, Nov. 5, 2009.
Infringement Chart—LG Vu CU920. Patent: 7,411,556, Fractus, Nov. 5, 2009.
Infringement Chart—LG VX5400, Fractus, Nov. 5, 2009.
Infringement Chart—LG VX5400. Patent: 7,411,556, Fractus, Nov. 5, 2009.
Infringement Chart—LG VX5500, Fractus, Nov. 5, 2009.
Infringement Chart—LG VX5500. Patent: 7,411,556, Fractus, Nov. 5, 2009.
U.S. Appl. No. 12/652,974—Notice of allowance dated on Aug. 10, 2011, USPTO.
U.S. Appl. No. 12/652,974—Notice of Allowance dated on Feb. 17, 2011, USPTO.
U.S. Appl. No. 12/652,974—Office Action dated on Jun. 23, 2010, USPTO.
U.S. Appl. No. 12/652,974—Response to the Office Action dated on Jun. 23, 2010, Winstead, Dec. 20, 2010.
U.S. Appl. No. 13/029,382—Notice of allowance dated May 10, 2012, USPTO.
U.S. Appl. No. 95/000,590—Request for inter partes reexamination of US patent No. 7,411,556 dated on Dec. 16, 2010—Exhibits, Kyocera.
U.S. Appl. No. 95/000,600—Request for Inter partes reexamination of US patent No. 7,411,556 dated on Dec. 3, 2010—Exhibits, HTC.
U.S. Appl. No. 95/001,389—Office Action for the US patent 7,123,208 dated on Aug. 12, 2010, USPTO.
U.S. Appl. No. 95/001,390—Office Action for the US patent 7,015,868 dated Aug. 19, 2010, USPTO.
U.S. Appl. No. 95/001,390—Response to the Office Action for the US patent 7,015,868 dated on Aug. 19, 2010, Sterne, Kessler, Goldstein & Fox PLLC.
U.S. Appl. No. 95/001,462—Request for inter partes reexamination of US patent 7,411,556 dated on Oct. 1, 2010—Exhibits, Samsung.
U.S. Appl. No. 95/001,462 , U.S. Appl. No. 95/000,590—Action closing prosecution for US patent 7,411,556 dated on Dec. 14, 2011, USPTO.
U.S. Appl. No. 95/001,462 , U.S. Appl. No. 95/000,590—Decision sua sponte to merge reexamination proceedings of US patent 7,411,556, UPSTO, May 5, 2011.
U.S. Appl. No. 95/001,462 , U.S. Appl. No. 95/000,590—Office Action of US patent 7,411,556 dated on May 6, 2011, USPTO.

(56) References Cited

OTHER PUBLICATIONS

U.S. Appl. No. 95/001,462 , U.S. Appl. No. 95/000,590—Patent owner's response to Action Closing Prosecution for US patent 7,411,556, Sterne Kessler, Jan. 17, 2012.
U.S. Appl. No. 95/001,462 , U.S. Appl. No. 95/000,590—Response to the Office Action dated May 6, 2011 of US patent US7,411,556, Sterne Kessler, Aug. 6, 2011.
U.S. Appl. No. 95/001,462 , U.S. Appl. No. 95/000,590—Right of appeal notice for US patent 7,411,556, USPTO, Mar. 12, 2012.
U.S. Appl. No. 95/001,462 , U.S. Appl. No. 95/000,590—Third party requester's comments to patent owner's reply of Jan. 7, 2012 for US patent 7,411,556, Samsung, Feb. 16, 2012.
U.S. Appl. No. 95/001,462 , U.S. Appl. No. 95/000,590—Third party requester's notice of appeal for US patent 7,411,556, Defendants, Apr. 12, 2012.
U.S. Appl. No. 95/001,462 , U.S. Appl. No. 95/001,590—Third party requester's comments to patent owner's reply of Aug. 8, 2011 for US patent 7,411,556, Defendants, Sep. 7, 2011.
U.S. Appl. No. 95/001,462, U.S. Appl. No. 95/000,590—Reply to Third Party Requester's notice of appeal filed on Apr. 12, 2012 for US patent 7,411,556, Sterne Kessler, May 31, 2012.
CN00818542—Response to Office Action dated on Nov. 5, 2004, Herrero Asodados, May 31, 2005.
CN01823716—Office action dated on Feb. 16, 2007, CCPIT Patent and Trademark Law Office—Chinese Patent Office.
CN01823716—Office action dated Sep. 21, 2007, CCPIT Patent and Trademark Law Office—Chinese Patent Office.
CN01823716—Response to the office action dated on Feb. 16, 2007, CCPIT Patent and Trademark Law Office—Chinese Patent Office, Aug. 21, 2007.
CN01823716—Response to the office action dated on Sep. 21, 2007, CCPIT Patent and Trademark Law Office—Chinese Patent Office, Dec. 3, 2007.
EP00909089—Claims, Herrero y Asociados, Jan. 28, 2005.
EP00909089—Minutes from Oral Proceedings, EPO, Jan. 28, 2005.
EP00909089—Office Action dated on Feb. 7, 2003, European Patent Office EPO.
EP00909089—Response to Office Action dated on Feb. 7, 2003, Herrero y Asociados, Aug. 14, 2003.
EP00909089—Summons to attend oral proceedings, EPO, Oct. 28, 2004.
EP00909089—Written submissions, Herrero y Asociados, Dec. 15, 2004.
EP02808256—Response to the summons to attend oral proceedings dated on Oct. 21, 2010, Herrero & Asociados.
EP02808265—Summons to attend oral proceedings in connection dated on Jun. 25, 2010., European Patent Office—EPO, Jun. 30, 2010.
EP10180818—Search Report dated on Dec. 13, 2010, European Patent Office.
PCT/EP00/00411—International preliminary examination report dated on Aug. 29, 2002—Notification concerning documents transmitted, European Patent Office ( EPO ).
PCT/ES99/00296—International Preliminary Examination Report, EPO, Dec. 19, 2001.
PCT/ES99/00296—International Search Report, OEPM, Mar. 29, 2001.
PCT/ES99/00296—Reply to the Written Opinion dated on Nov. 15, 2001—Declaration of J. Baxter—Exhibit FFF—, Herrero & Asociados.
Posio , E. , Letter to FCC—Electronic Serial No. For FCC ID: GMLNPW-3 , Nokia Mobile Phones , Dec. 7, 2001.
Posio , E. , Letter to FCC about GMLNSW-4DX complies with ANSI/IEEE C95.1-1992 Standard for Safety Levels , Nokia Mobile Phones , Mar. 7, 2000.
Posio , E. , Letter to FCC—Electronic Serial No. For FCC ID: GMLNSW-4DX , Nokia Mobile Phones , Feb. 7, 2000.
Poularikas , A. , Handbook of antennas in wireless communications, CRC Press , Jan. 1, 2002.
Pozar , David M. , Microwave Engineering—Chapter 12: Introduction to Microwave Systems , Addison-Wesley , Jan. 1, 1990 , pp. 663-666 , 675-676.
Pozar , David M. ; Newman , E. , Analysis of a Monopole Mounted near or at the Edge of a Half-Plane , IEEE Transactions on Antennas and Propagation , May 1, 1981 , AP-29 , No. 3.
Pozar , David M. ; Schaubert , Daniel H. , Microstrip antennas. The analysis and design of microstrip antennas and arrays , IEEE Press; Pozar, Schaubert , Jan. 1, 1995 , p. 431.
Pressley, A , Elementary Differential Geometry , Springer , Jan. 1, 2000 , pp. 252-257.
Pribetich , P. ; Combet , Y. et al , Quasifractal planar microstrip resonators for microwave circuits , Microwave and Optical Technology Letters , Jun. 20, 1999 , vol. 21 , No. 6 , pp. 433-436.
Puente , C. , Fractal multiband antenna based on the Sierpinski gasket, Electronic letters , Jan. 4, 1996.
Puente , C. , Fractal antennas , Universitat Politecnica de Catalunya , May 1, 1997.
Puente , C. ; Anguera , J. ; Romeu , J.; Borja , C. ; Navarro , M. ; Soler, J. , Fractal-shaped antennas and their application to gsm 900 1800 , Antennas and Propagation Society International Symposium, 2000. IEEE , Apr. 1, 2000.
Puente , C. ; Claret , J. ; Sagues , F. et al , Multiband properties of a fractal tree antenna generated by electrochemical deposition , Electronic Letters , Dec. 5, 1996 , vol. 32 , No. 25 , pp. 2298-2299.
Puente , C. ; Romeu , J. ; Bartolome , R. ; Pous , R. , Perturbation of the Sierpinski antenna to allocate operating bands , Electronic Letters , Nov. 21, 1996 , vol. 32, No. 24.
Puente , C. ; Romeu , J. ; Cardama , A. , Fractal-shaped antennas , Frontiers in electromagnetics—IEEE Press , Jan. 1, 2000 , Chapter 2, pp. 48-50.
Puente , C. ; Romeu , J. ; Cardama , A. ; Pous , R. , Multiband fractal antennas and arrays , Fractals engineering—from theory to industrial applications , Jan. 1, 1997.
Puente , C. ; Romeu , J. ; Cardama , A. ; Pous , R. , On the behavior of the Sierpinski multiband fractal antenna , Antennas and Propagation, IEEE Transactions on , Apr. 1, 1998 , vol. 46 , No. 4.
Puente , C. ; Romeu , J. ; Cardama, A. , The Koch monopole—a small fractal antenna , Antennas and Propagation, IEEE Transactions on , Nov. 1, 2000 , vol. 48 , No. 11.
Puente , C. et al , Small but long Koch fractal monopole , Electronic Letters, Jan. 8, 1998 , vol. 34 , No. 1 , pp. 9-10.
Rademacher , H. ; Toeplitz , O. , The Enjoyment of Math , Princeton Science Library , Jan. 1, 1957 , pp. 164-169.
Rensh , Y. A. , Broadband microstrip antenna , Proceedings of the Moscow International Conference on Antenna Theory and Tech , Sep. 22, 1998 , vol. 28 , pp. 420-423.
Rich , Barnett , Review of Elementary Mathematics 2d ed.1997 , McGraw - Hill , Jan. 1, 1997 , pp. 245-247.
Romeu , J. et al , Fractal FSS—A novel dual-band frequency selective surface , Antennas and Propagation, IEEE Transactions on , Jul. 1, 2000.
Rosa , J. ; Case E. W. , A wide angle circularly polarized omnidirectional array antenna , Symposium on the USAF antenna Research and Development Program , 18th , Oct. 15, 1968.
Rotman , W. , Problems encountered in the design of flush-mounted antennas for high speed aircraft , Symposium on the USAF Antenna Research and Development Program, 2nd , Oct. 19, 1952 , vol. 46.
Rouvier , R. et al. , Fractal analysis of bidimensional profiles and application to electromagnetic scattering from soils , IEEE , Jan. 1, 1996.
Rowell , C. R. ; Murch , R.D. , A capacitively loaded PIFA for compact mobile telephone handsets , Antennas and Propagation, IEEE Transactions on , May 1, 1997.
Rowell , Corbett R. ; Murch , R. D. , A compact PIFA suitable for dual-frequency 900-1800-MHz operation , Antennas and Propagation, IEEE Transactions on , Apr. 1, 1998.
Rumsey, V. , Frequency independent antennas , Academic Press , Jan. 1, 1996 , pp. 2-3.
Russell , D. A. et al. , Dimension of strange attractors , Physical Review Letters , Oct. 6, 1980 , vol. 45 , No. 14.

(56) References Cited

OTHER PUBLICATIONS

Salow , S. , Request for confidentiality of the information accompanyinh the application of FCC ID: LJPNPW-1NB , M. Flom Associates—MFA , Feb. 26, 2001.
Salow , S. , Letter to FCC—FCC ID LJPNPW-1NB complies with OET Bulletin No. 53 as referenced in Section 22.915 of the Commissions rules and with EIA/TIA/IS-54-B , Nokia Mobile Phones , Feb. 26, 2001.
Salow , S. , Letter to FCC—About LJPNPW-1 NB complies with ANSI/IEEE C95.1-1992 Standard for Safety Levels , Nokia Mobile Phones , Feb. 26, 2001.
Sanchez Hernandez , David et al , Analysis and design of a dual-band circularly polarized microstrip patch antenna , Antennas and Propagation, IEEE Transactions on , Feb. 1, 1995.
Sandlin , B. ; Terzouli , A. J. , A genetic antenna desig for improved radiation over earth , Antenna Applications Symposium , Program for 1997—Allerton Conference Proceedings , Sep. 17, 1997.
Sarkar , N. , An efficient differential box-counting approach to compute fractal dimension of image , IEEEn Transactions on System, Man and Cybernetics , Jan. 3, 1994 , vol. 24 , No. 1.
Saunders , S. R. , Antennas and Propagation for Wireless Communication Systems—Chapter 4 , John Wiley & Sons , Jan. 1, 1999.
Sawaya , K. ; Ishizone , T. ; Mushiake , Y. , A simplified Expression of Dyadic Green's Function for a Conduction Half Sheet vol. AP-29, No. 5 (Sep. 1981) , IEEE Transactions on Antennas & Propagation , Sep. 1, 1981 , AP-29 , No. 5.
Scharfman , W. , Telemetry antennas for high altitude missiles , Symposium on the USAF antenna research and development program, 8th , Oct. 20, 1958.
Schaubert , D. H. ; Chang , W. C. ; Wunsch , G. J. , Measurement of phased array performance at arbitrary scan angles , Antenna Applications Symposium , Sep. 21, 1994.
Sclater , N. ; Markus , J. , McGraw-Hill Electronics Dictionary , Mc-Graw Hill , Jan. 1, 1997 , pp. 21, 35, 183, 263, 298, 300.
Seavey , John , C-band paste-on and floating ring reflector antennas , Symposium on The USAF Antenna Research and Development Program, 23th , Oct. 10, 1973.
Shafer , G , Probability and Finance , John Wiley & Sons , Jan. 1, 2001.
Shenoy , A. et al. , Notebook satcom terminal technology development , International Conference on Digital Satellite Communications, 10th , May 15, 1995.
Shibagaki , N. , Saw antenna duplexer module using saw-resonator-coupled filter for PCN system , IEEE Ultrasonics symposium , Oct. 5, 1998 , vol. 1.
Shibagaki , N. ; Sakiyama , K. ; Hikita , M. , Miniature saw antenna duplexer module for 1.9GHz PCN systems using saw-resonator-coupled filters , IEEE Ultrasonics Symposium , Oct. 5, 1998 , vol. 1.
Shimoda , R. Y. , A variable impedance ratio printed circuit balun , Antenna Applications Symposium , Sep. 26, 1979.
Shnitkin , H. , Analysis of log-periodic folded dipole array , Antenna Applications Symposium , Sep. 10, 1992.
Sim , D. , An internal triple-band antenna for PCS/IMT-2000/Bluetooth applications , Antennas and Wirelessss Propagation Letters, IEEE , Jan. 1, 2004 , vol. 3.
Sinclair, G. , Theory of models of electromagnetic systems , Proceedings of the IRE , Nov. 1, 1948.
Snow , W. L. , UHF crossed-slot antenna and applications , Symsposium on the USAF Antenna Research and Development program, 19th , Sep. 1, 1963.
Snow , W. L. , Ku-band planar spiral antenna , Symposium on the USAF Antenna Research and Development Program, 19th , Oct. 14, 1969.
So , P. et al , Box-counting dimension without boxes—Computing D0 from average expansion rates , Physical Review E , Jul. 1, 1999 , vol. 60 , No. 1.
Soler , J. ; Romeu , J. , Dual-band sierpinski fractal monopole antenna, Antennas and Propagation Society International Symposium, 2000. IEEE , Jul. 1, 2000 , pp. 1712-1715.
Soler , J. ; Romeu , J. ; Puente , C. , Mod-P Sierpinski fractal multiband antenna , Antennas and Propagation Society International Symposium, 2000. IEEE , Apr. 4, 2000.
Song, C. T. P. , Fractal stacked monopole with very wide bandwidth, Electronic Letters , Jun. 1, 1999 , vol. 35 , pp. 945-946.
Stang , P. F. , Balanced flush mounted log-periodic antenna for aerospace vehicles—in Abstracts of the Twelfth Annual Symposium USAF antenna research , Symposium on USAF antenna Research and Development, 12th , Oct. 16, 1962 , vol. 1.
Strugatsky , A. et al , Multimode multiband antenna , Tactical communications: Technology in transition. Proceedings of the tactical communications conference , Apr. 28, 1992.
Stutzman , W. L. ; Thiele , G. , Antenna theory and design , John Wiley and Sons , Jan. 1, 1981 , pp. 18, 36.
Stutzman , W. L. ; Thiele , G. A. , Antenna theory and design , John Wiley and Sons , Jan. 1, 1998 , pp. 8-9 , 43-48 , 210-219.
Stutzman , W. L. ; Thiele , G. A. , Antenna theory and design—Chapter 5—Resonant Antennas: Wires and Patches , Wiley , Jan. 1, 1998 , Chapter 5 (selected page) , p. 210.
Szkipala , L. , Fractal antennas , TEAT , Apr. 26, 2001.
Taga , T. , Performance analysis of a built-in planar inverted F antenna for 800 MHz band portable radio units , IEEE Journal on Selected Areas in Communications , Jan. 1, 1987 , vol. 5 , No. 5.
Tai , Chen to ; Long , Stuart. , Antenna engineering handbook—Chapter 4—Dipoles and Monopoles , Johnson , R. Mc Graw Hill—(3rd Ed.) , Jan. 1, 1993 , pp. 4-26 - 4-33.
Tang , Y. , The application of fractal analysis to feature extraction , IEEE , Jan. 1, 1999.
Tanner , R. L. ; O'Reilly , G. A. , Electronic counter measure antennas for a modern electronic reconnaissance aircraft , Symposium on the USAF antenna research and development program, 4th , Oct. 17, 1954.
Teeter , W. L. ; Bushore , K. R. , A variable-ratio microwave power divider and multiplexer , IRE Transactions on microwave theory and techniques , Oct. 1, 1957.
Teng , P. L. ; Wong , K. L. , Planar monopole folded into a compact structure for very-low-profile multiband mobile-phone antenna , Microwave and optical technology letters , Apr. 4, 2002.
Terman , F. E. , Radio engineering , McGraw-Hill Book Company, Inc. , Jan. 1, 1947 , pp. 73-74, 690-691, 730.
The Glenn L. Martin Company , Antennas for USAF B-57 series bombers , Symposium on the USAF antenna research and development program, 2nd , Oct. 19, 1952.
Theiler , J. , Estimating fractal dimension , J. Opt. Soc. Am. A. Case 6:09-cv-00203-LED-JDL , Jun. 1, 1990 , vol. 7 , No. 6 , pp. 1055-1073.
Turner , E. M. , Broadband passive electrically small antennas for TV application , Proceedings of the 1977 Antenna Applications Symposium , Apr. 27, 1977.
Turner , E. M. ; Richard , D. J. , Development of an electrically small broadband antenna , Symposium on the USAF antenna research and development program, 18th , Oct. 15, 1968.
Verdura, O. , Miniature fractal antenna : Antena fractal miniatura , Universitat Politecnica de Catalunya , Sep. 1, 1997.
Vinoy , K. J. et al , Hilbert curve fractal antenna: a small resonant antenna for VHF/UHF applications , Microwave and Optical Technology Letters , May 1, 2001 , vol. 29 , No. 4 , pp. 215-219.
Virga , K. L. , Low-profile enhanced-bandwidth PIFA antennas for wireless communications packaging , Microwave Theory and Techniques, IEEE Transactions on , Oct. 10, 1997 , vol. 45.
Walker , G. J. et al , Fractal volume antennas , Electronic Letters , Aug. 6, 1998.
Wall , H. ; Davies , H. W. , Communications antennas for mercury space capsule , Symposium on the USAF antenna research and development program, 11th , Oct. 16, 1961.
Watanabe , T. ; Furutani , K. ; Nakajima , N. et al , Antenna switch duplexer for dualband phone (GSM / DCS) using LTCC multilayer technology , IEEE MTT-S International Microwave Symposium Digest , Jun. 19, 1999.
Watson , T. ; Friesser , J. , A phase shift direction finding technique , Annual Symposium on the USAF antenna research and development program , Oct. 21, 1957.

(56) References Cited

OTHER PUBLICATIONS

Weeks , W. L. , Eletromagnetic theory for engineering applications , John Wiley & Sons , Jan. 1, 1964 , pp. 46-50.
Weeks , W. L. , Antenna engineering , McGraw-Hill Book Company, Jan. 1, 1968 , pp. 167-180.
Wegner , D. E. , B-70 antenna system , Symposium on the USAF antenna research and development program, 13th , Oct. 14, 1963.
Werner , D. H and Mittra , R. , Frontiers in electromagnetics , IEEE Press , Jan. 1, 2000 , pp. 5-7.
Werner , D. H. ; Werner , P. L. ; Ferrare , A. J. , Frequency independent features of self-similar fractal antennas , Antennas and Propagation Society International Symposium, 1996. AP-S. Digest , Jul. 21, 1996.
Werner , D. H. ; Werner , P. L. ; Jaggard , D. L. ; Jaggard , A. D. ; Puente , C. ; Haupt , R. L. , Frontiers in Electromagnetics—Chapter 3—The Theory and design of fractal antenna arrays , IEEE Press Series , Jan. 1, 2000 , pp. 94-203.
West , B.H. et al. , The Prentice-Hall Encyclopedia of Mathematics (1982) , Prentice-Hall , Jan. 1, 1982 , pp. 404-405.
Wheeler , H. A. , Fundamental limitations of small antennas , Proceedings of the I.R.E. , Jan. 1, 1947.
Wheeler , H. A. , Small antennas , Symposium on the USAF antenna research and development program, 23rd , Oct. 10, 1973.
Wheeler , H. A. , The radiansphere around a small antenna , Proceedings of the IRE , Aug. 1, 1959.
Wikka , K. , Letter to FCC that will authorize the appointment of MORTOM FLOM Eng and/or FLOMASSOCIATES INC to act as their Agent in all FCC matters , Nokia Mobile Phones , Aug. 5, 1999.
Wong , K. L. ; Kuo , J. S. ; Fang , S. T. et al , Broadband microstrip antennas with integrated reactive loading , Asia Pacific Microwave Conference , Dec. 3, 1999.
Wong , K. L. ; Sze , J. Y. , Dual-frequency slotted rectangular microstrip antenna , Electronic Letters , Jul. 9, 1998.
Wong , Kin-Lu , Planar antennas for wireless communications_Full, Wiley Interscience , Jan. 1, 2003.
Wong , Kin-Lu , Modified planar inverted F antenna , Electronic Letters , Jan. 8, 1998.
Yang , Kai-Ping , Compact dual-frequency operation of rectangular microstrip antennas , Antennas and Propagation Society International Symposium, 1999. IEEE , Jul. 1, 1999.
Zhang , Dawei ; Liang , G.C. ; Shih , C.F. , Narrowband lumped element microstrip filters using capacitively loaded inductors , Microwave Symposium Digest, 1995., IEEE MTT-S International , May 16, 1995 , pp. 379-382.
Zhang , S. Huff , G. ; Bernhard , T. , Antenna efficiency and gain of two new compact microstrip antennas , Antenna Applications symposium, 2001 , Sep. 19, 2001.
Document 0001—Complaint for patent infringement, Susman Godfrey, May 5, 2009.
Document 0014—Amended complaint for patent infringement, Fractus, May 6, 2009.
McDowell , E. P. , Flush mounted X-band beacon antennas for aircraft , Symposium on USAF antenna Research and Development, 3th , Oct. 18, 1953.
McDowell , E. P. , High speed aircraft antenna problems and some specific solutions for MX-1554 , Symposium on the USAF Antenna Research and Development Program, 2nd , Oct. 19, 1952.
McSpadden , J. O. , Design and experiments of a high-conversion-efficiency 5.8-GHz rectenna , IEEE Transactions on Microwave Theory and Techniques , Dec. 1, 1998 , vol. 46.
Mehaute, A. , Fractal Geometrics , CRC Press , Jan. 1, 1990 , pp. 3-35.
Meier , K. ; Burkhard , M. ; Schmid , T. et al , Broadband calibration of E-field probes in Lossy Media , IEEE Transactions on Microwave Theory and Techniques , Oct. 1, 1996 , vol. 44 , No. 10.
Misra , S. , Experimental investigations on the impedance and radiation properties of a three-element concentric microstrip square-ring antenna , Microwave and Optical TEchnology Letters , Feb. 5, 1996, vol. 11 , No. 2.
Misra , S. ; Chowdhury , S. K. , Study of impedance and radiation properties of a concentric microstrip triangular-ring antenna and Its modeling techniques using FDTD method , IEEE Transactions on Antennas and Propagation , Apr. 1, 1998 , vol. 46 , No. 4.
Moheb , H. , Design and development of co-polarized ku-band ground terminal system for very small aperture terminal (VSAT) application , IEEE International Symposium on Antennas and Propagation Digest , Jul. 11, 1999.
Morishita , H. et al , Design concept of antennas for small mobile terminals and the future perspective , Antennas and Propagation Magazine, IEEE , Oct. 1, 2002.
Munson , R. , Conformal microstrip array for a parabolic dish , Symposium on the USAF Antenna Research and Development Program , Oct. 1, 1973.
Munson , R. , Microstrip phased array antennas , Symposium on The USAF Antenna Research and Development Program, 22th , Oct. 11, 1972.
Munson , R. E. , Conformal microstrip communication antenna , Symposium on USAF antenna Research and Development, 23th , Oct. 10, 1973.
Mushiake, Yasuto , Self-Complementary Antennas : Principle of Self Complementarity for Constant Impedance , Springer-Verlag , Jan. 1, 1996 , pp. 81-86.
Myrskog , M , Letter to FCC—Letter that will authorize the appointment of MORTON FLOM Eng and/or FLOMASSOCIATES INC to act as their Agent in all FCC matters , Nokia Mobile Phones , Sep. 14, 2000.
NA , Software—Box counting dimension [electronic] , http://www.sewanee.edu/Physics/PHYSICS123/Box%20C0UNTING%20DIMENSION.html , Apr. 1, 2002.
NA , Nokia. Internal Photos—FCC ID: GMLNPW-3 , Federal Communications Commission—FCC , Dec. 19, 2001.
NA , Nokia 8260—FCC ID GMLNSW-4DX , Nokia , Apr. 1, 1999.
NA , Digital cellular telecommunications system (Phase2); Mobile Station (MS) conformance specification; Part 1: Conformance specification (GSM 11.10-1 version 4.21.1) , ETSI , Aug. 1, 1998.
NA , Dictionary of Scientific and Technical Terms (6 ed) , McGraw-Hill , Jan. 1, 2002 , pp. 1489 and 1634.
NA , FCC—United States table of frequency allocations , Federal Communications Commission , Oct. 1, 1999 , pp. 377-538.
NA , United States Table of Frequency allocations—The Radio Spectrum , United States Department of Commerce , Mar. 1, 1996.
NA , Nokia 8290 , Nokia , Jun. 1, 2010.
NA , Letter to FCC—Application form 731 and Engineering Test Report by Nokia Mobile Phones for FCC ID: LJPNSW-6NX , M. Flom Associates , Apr. 1, 1999.
NA , Nokia 8860—External photos—OET Exhibits list for FCC ID: LJPNSW-6NX , Federal Communications Commission—FCC , Jul. 8, 1999.
NA , SAR- Evaluation—DASY Dipole ValidationKit—Type: D1900V2—Serial: 511 , Schimd and Partner Engineering AG , Feb. 13, 2001.
NA , SAR- Evaluation—DASY Dipole Validation Kit—Type: D835V2—Serial: 405 , Schmid and Partner Engineering AG , Feb. 13, 2001.
NA , Nokia. Antenna Photos—FCC ID: GMLNPW-3 , Federal Communications Commission—FCC , Feb. 19, 2002.
NA , OET Exhibits List for FCC ID: GMLNSW-4DX , Office of Engineering and Technology—FCC , Sep. 8, 2000.
NA , OET Exhibits list for FCC ID: LJPNPW-1NB , Federal Communications Commission—FCC , May 3, 2001.
NA , IEEE Standard Dictionary of Electrical and Electronics Terms , IEEE Press (6th ed.) , Jan. 1, 1996 , pp. 359, 688, and 878.
NA , Int'l Electro-Technical Commission IEV No. 712-01-04—Electropedia : the world's online electrotechnical vocabulary , Electropedia—Commission Electrotechnique Internationale—http://www.electropedia.org , Apr. 1, 1998.
NA , Webster's New Collegiate Dictionary , G & C Merriam Co. , Jan. 1, 1981 , pp. 60, 237, 746.
NA , The American Century Dictionary , Oxford University Press , Jan. 1, 1995 , pp. 376, 448.
NA , IEEE Standard dictionary of electrical and electronics terms , IEEE Standard (6th ed.) , Jan. 1, 1996 , pp. 229, 431, 595, 857.
NA , Collins Dictionary , Collins , Jan. 1, 1979 , p. 608.

(56) References Cited

OTHER PUBLICATIONS

NA , The Random House Dictionary , Random House , Jan. 1, 1984, pp. 1029, 1034.
NA , The American Heritage Dictionary , New College ed. (2nd ed. ), Jan. 1, 1982 , pp. 311, 1208.
NA , Merriam-Webster's Collegiate Dictionary (1993) , Merriam-Webster's. , Jan. 1, 1993 , p. 863.
NA , American Heritage College Dictionary (1997). Pags 340 and 1016 , Mifflin Comp. , 19970101 , pp. 340 , 1016.
NA , American Heritage Dictionary of the English Language , Houghton Mifflin Company , Jan. 1, 2000 , pp. 1306-1361.
NA , IEEE Standard Definitions of Terms for Antennas, IEEE Std. 145-1993 (1993) , The Institute of Electrical and Electronics Engineers , Mar. 18, 1993.
NA , The American Heritage Dictionary , Morris—William—(Second College edition) , Jan. 1, 1982 , pp. 817 , 961.
NA , The American Heritage College Dictionary , Houghton Mifflin Comp.—3d ed. , Jan. 1, 1997 , pp. 684 and 1060.
NA , European Patent Convention—Article 123 , European Patent Office , Jan. 1, 2000 , pp. 132-133.
NA , RIM 950 product—Photos of , RIM , Jun. 30, 1998.
NA , RIM 957 page maker , RIM , Nov. 15, 2000.
NA , RIM 857 pager , RIM , Oct. 1, 2000.
NA , Nokia 8860—Internal photos—FCC ID: LJPNSW-6NX , Nokia and Federal Communications Commission ( FCC ) , Jun. 24, 1999.
NA , Nokia 8850 , Nokia , Jan. 1, 1999.
NA , Nokia 8810 , Nokia , Jan. 1, 1998.
U.S. Appl. No. 95/001,462—U.S. Appl. No. 95/000,590—Inter Partes Reexamination Certificate for US patent 7,411,556, dated Aug. 21, 2012.

* cited by examiner

MULTI-BAND MONOPOLE ANTENNA FOR A MOBILE COMMUNICATIONS DEVICE

CROSS-REFERENCE TO RELATED APPLICATIONS

This patent application is a continuation of U.S. patent application Ser. No. 13/029,382, filed on Feb. 17, 2011. U.S. patent application Ser. No. 13/029,382 is a continuation of U.S. patent application Ser. No. 12/652,974, filed on Jan. 6, 2010. U.S. patent application Ser. No. 12/652,974 is a continuation of U.S. Pat. No. 7,675,470, issued on Mar. 9, 2010. U.S. Pat. No. 7,675,470 is a continuation of U.S. Pat. No. 7,403,164, issued on Jul. 22, 2008. U.S. Pat. No. 7,403,164 is a continuation of U.S. Pat. No. 7,411,556, issued on Aug. 12, 2008. U.S. Pat. No. 7,411,556 is a continuation of International Patent Application No. PCT/EP02/14706, filed on Dec. 22, 2002. U.S. patent application Ser. No. 13/029,382, U.S. patent application Ser. No. 12/652,974, U.S. Pat. No. 7,675,470, U.S. Pat. No. 7,403,164, U.S. Pat. No. 7,411,556, and International Patent Application No. PCT/EP02/14706 are incorporated herein by reference.

BACKGROUND OF THE INVENTION

1. Technical Field of the Invention

This invention relates generally to the field of multi-band monopole antennas. More specifically, a multi-band monopole antenna is provided that is particularly well-suited for use in mobile communications devices, such as Personal Digital Assistants, cellular telephones, and pagers.

2. Description of Related Art

Multi-band antenna structures for use in a mobile communications device are known in this art. For example, one type of antenna structure that is commonly utilized as an internally-mounted antenna for a mobile communication device is known as an "inverted-F" antenna. When mounted inside a mobile communications device, an antenna is often subject to problematic amounts of electromagnetic interference from other metallic objects within the mobile communications device, particularly from the ground plane. An inverted-F antenna has been shown to perform adequately as an internally mounted antenna, compared to other known antenna structures. Inverted-F antennas, however, are typically bandwidth-limited, and thus may not be well suited for bandwidth intensive applications.

SUMMARY OF THE INVENTION

A multi-band monopole antenna for a mobile communications device includes a common conductor coupled to both a first radiating arm and a second radiating arm. The common conductor includes a feeding port for coupling the antenna to communications circuitry in a mobile communications device. In one embodiment, the first radiating arm includes a space-filling curve. In another embodiment, the first radiating arm includes a meandering section extending from the common conductor in a first direction and a contiguous extended section extending from the meandering section in a second direction.

A mobile communications device having a multi-band monopole antenna includes a circuit board, communications circuitry, and the multi-band monopole antenna. The circuit board includes an antenna feeding point and a ground plane. The communications circuitry is coupled to the antenna feeding point of the circuit board. The multi-band monopole antenna includes a common conductor, a first radiating arm and a second radiating arm. The common conductor includes a feeding port that is coupled to the antenna feeding point of the circuit board. The first radiating arm is coupled to the common conductor and includes a space-filling curve. The second radiating arm is coupled to the common conductor. In one embodiment, the circuit board is mounted in a first plane within the mobile communications device and the multi-band monopole antenna is mounted in a second plane within the mobile communications device.

DETAILED DESCRIPTION OF THE DRAWINGS

Various embodiments of the present invention will now be described more fully with reference to the accompanying drawings. The invention may, however, be embodied in many different forms and should not be construed as limited to the embodiments set forth herein; rather, the embodiments are provided so that this disclosure will be thorough and complete, and will fully convey the scope of the invention to those skilled in the art. The above summary of the invention is not intended to represent each embodiment or every aspect of the present invention.

Figure 1:
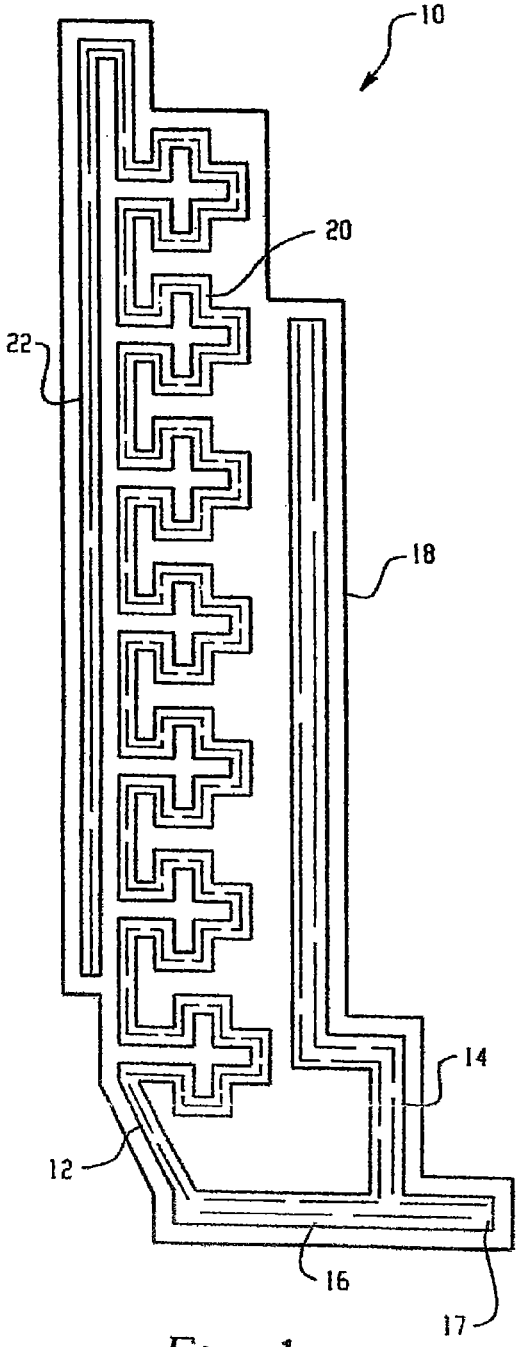
FIG. 1 is a top view of an exemplary multi-band monopole antenna for a mobile communications device.

Referring now to the drawing figures, FIG. 1 is a top view of an exemplary multi-band monopole antenna 10 for a mobile communications device. The multi-band monopole antenna 10 includes a first radiating arm 12 and a second radiating arm 14 that are both coupled to a feeding port 17 through a common conductor 16. The antenna 10 also includes a substrate material 18 on which the antenna structure 12, 14, 16 is fabricated, such as a dielectric substrate, a flex-film substrate, or some other type of suitable substrate material. The antenna structure 12, 14, 16 is preferably patterned from a conductive material, such as a metallic thick-film paste that is printed and cured on the substrate material 18, but may alternatively be fabricated using other known fabrication techniques.

The first radiating arm 12 includes a meandering section 20 and an extended section 22. The meandering section 20 is coupled to and extends away from the common conductor 16. The extended section 22 is contiguous with the meandering section 20 and extends from the end of the meandering section 20 back towards the common conductor 16. In the illustrated embodiment, the meandering section 20 of the first radiating arm 12 is formed into a geometric shape known as a space-filling curve, in order to reduce the overall size of the antenna 10. A space-filling curve is characterized by at least ten segments which are connected in such a way that each segment forms an angle with its adjacent segments, that is, no pair of adjacent segments define a larger straight segment. It should be understood, however, that the meandering section 20 may include other space-filling curves than that shown in FIG. 1, or may optionally be arranged in an alternative meandering geometry. FIGS. 2-6, for example, illustrate antenna structures having meandering sections formed from several alternative geometries. The use of shape-filling curves to form antenna structures is described in greater detail in the co-owned PCT Application WO 01/54225, entitled Space-Filling Miniature Antennas, which is hereby incorporated into the present application by reference.

The second radiating arm 14 includes three linear portions. As viewed in FIG. 1, the first linear portion extends in a vertical direction away from the common conductor 16. The second linear portion extends horizontally from the end of the first linear portion towards the first radiating arm. The third linear portion extends vertically from the end of the second linear portion in the same direction as the first linear portion and adjacent to the meandering section 20 of the first radiating arm 14.

Figure 10:
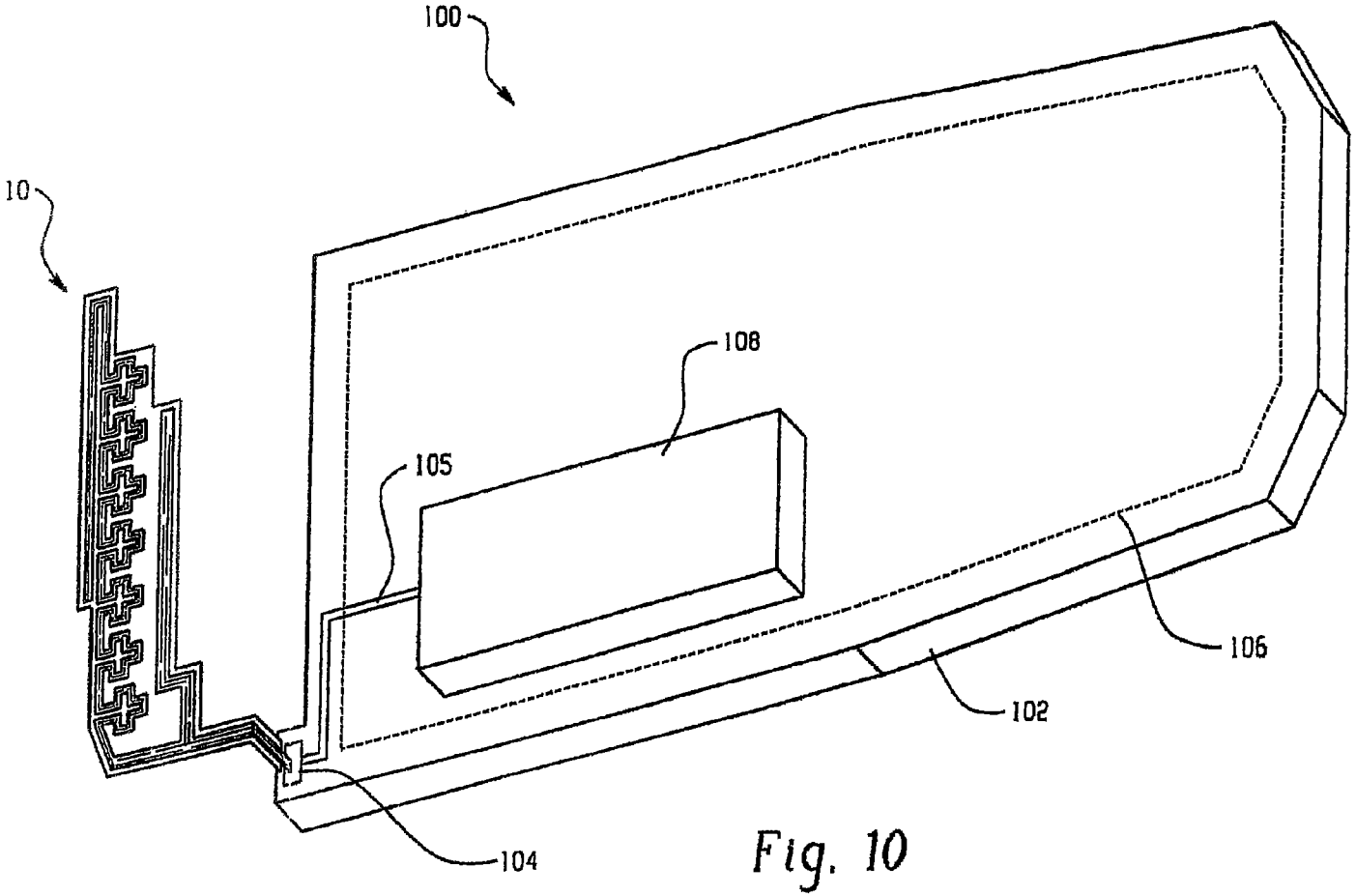
FIG. 10 is a top view of the exemplary multi-band monopole antenna of FIG. 1 coupled to a circuit board for a mobile communications device.

As noted above, the common conductor 16 of the antenna 10 couples the feeding port 17 to the first and second radiating arms 12, 14. The common conductor 16 extends horizontally (as viewed in FIG. 1) beyond the second radiating arm 14, and may be folded in a perpendicular direction (perpendicularly into the page), as shown in FIG. 10, in order to couple the feeding port 17 to communications circuitry in a mobile communications device.

Operationally, the first and second radiating arms 12, 14 are each tuned to a different frequency band, resulting in a dual-band antenna. The antenna 10 may be tuned to the desired dual-band operating frequencies of a mobile communications device by pre-selecting the total conductor length of each of the radiating arms 12, 14. For example, in the illustrated embodiment, the first radiating arm 12 may be tuned to operate in a lower frequency band or groups of bands, such as PDC (800 MHz), CDMA (800 MHz), GSM (850 MHz), GSM (900 MHz), GPS, or some other desired frequency band. Similarly, the second radiating arm 14 may be tuned to operate in a higher frequency band or group of bands, such as GPS, PDC (1500 MHz), GSM (1800 MHz), Korean PCS, CDMA/PCS (1900 MHz), CDMA2000/UMTS, IEEE 802.11 (2.4 GHz), or some other desired frequency band. It should be understood that, in some embodiments, the lower frequency band of the first radiating arm 12 may overlap the higher frequency band of the second radiating arm 14, resulting in a single broader band. It should also be understood that the multi-band antenna 10 may be expanded to include further frequency bands by adding additional radiating arms. For example, a third radiating arm could be added to the antenna 10 to form a tri-band antenna.

Figure 2:
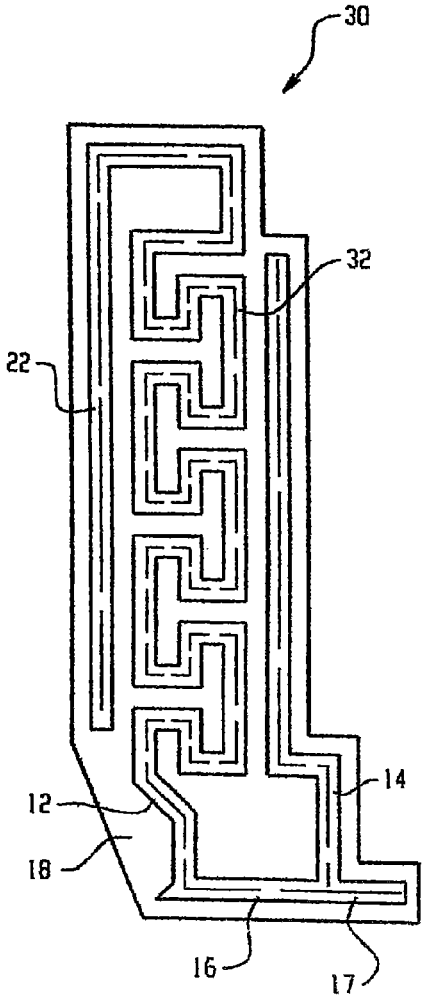
FIG. 2 is a top view of an exemplary multi-band monopole antenna including one alternative space-filling geometry.

FIG. 2 is a top view of an exemplary multi-band monopole antenna 30 including one alternative space-filling geometry. The antenna 30 show in FIG. 2 is similar to the multi-band antenna 10 shown in FIG. 1, except the meandering section 32 in the first radiating arm 12 includes a different space-filling curve than that shown in FIG. 1.

FIGS. 3-9 illustrate several alternative multi-band monopole antenna configurations 50, 70, 80, 90, 93, 95, 97. Similar to the antennas 10, 30 shown in FIGS. 1 and 2, the multi-band monopole antenna 50 illustrated in FIG. 3 includes a common conductor 52 coupled to a first radiating arm 54 and a second radiating arm 56. The common conductor 52 includes a feeding port 62 on a linear portion of the common conductor 52 that extends horizontally (as viewed in FIG. 3) away from the radiating arms 54, 56, and that may be folded in a perpendicular direction (perpendicularly into the page) in order to couple the feeding port 62 to communications circuitry in a mobile communications device.

The first radiating arm 54 includes a meandering section 58 and an extended section 60. The meandering section 58 is coupled to and extends away from the common conductor 52. The extended section 60 is contiguous with the meandering section 58 and extends from the end of the meandering section 58 in an arcing path back towards the common conductor 52.

The second radiating arm 56 includes three linear portions. As viewed in FIG. 3, the first linear portion extends diagonally away from the common conductor 52. The second linear portion extends horizontally from the end of the first linear portion towards the first radiating arm. The third linear portion extends vertically from the end of the second linear portion away from the common conductor 52 and adjacent to the meandering section 58 of the first radiating arm 54.

Figure 3:
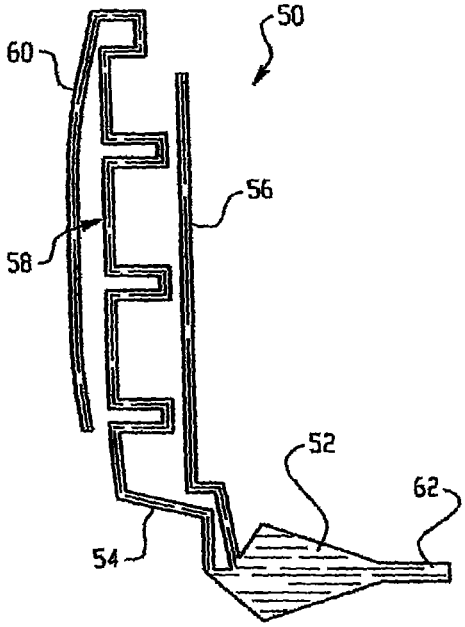
FIGS. 3-9 illustrate several alternative multi-band monopole antenna configurations.
Figure 4:
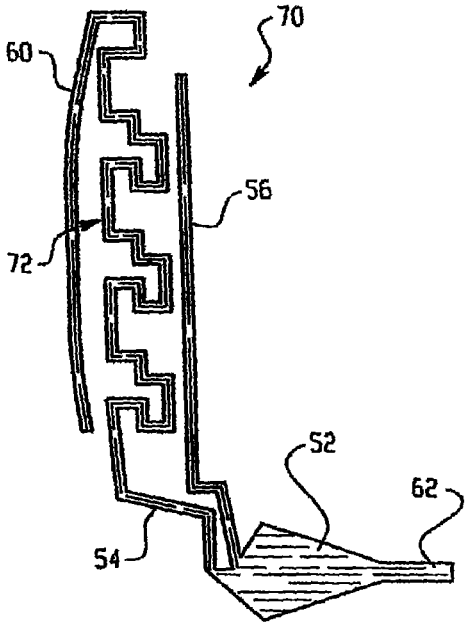
Figure 5:
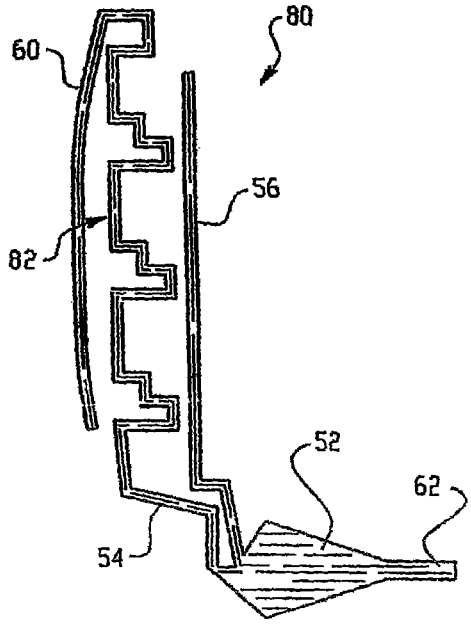
Figure 6:
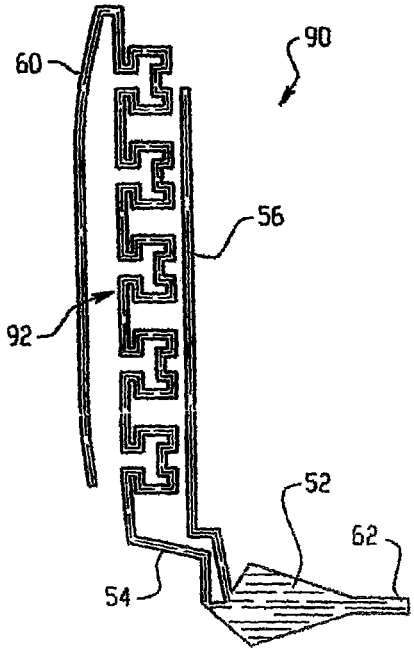

The multi-band monopole antennas 70, 80, 90 illustrated in FIGS. 4-6 are similar to the antenna 50 shown in FIG. 3, except each includes a differently-patterned meandering portion 72, 82, 92 in the first radiating arm 54. For example, the meandering portion 92 of the multi-band antenna 90 shown in FIG. 6 meets the definition of a space-filling curve, as described above. The meandering portions 58, 72, 82 illustrated in FIGS. 3-5, however, each include differently-shaped periodic curves that do not meet the requirements of a space-filling curve.

Figure 9:
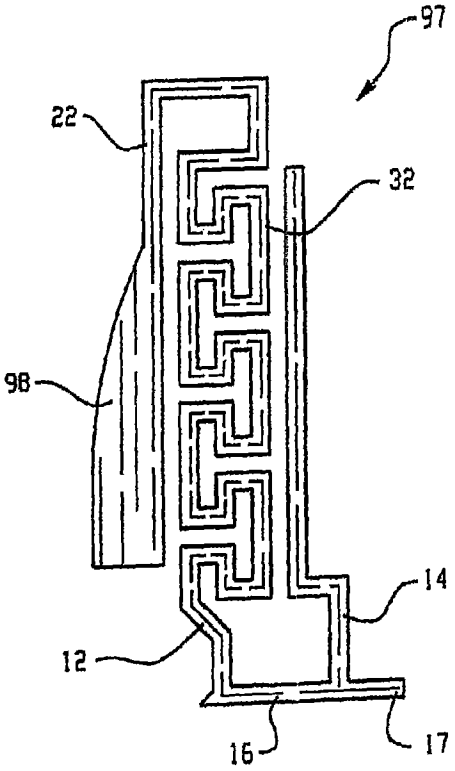
Figure 8:
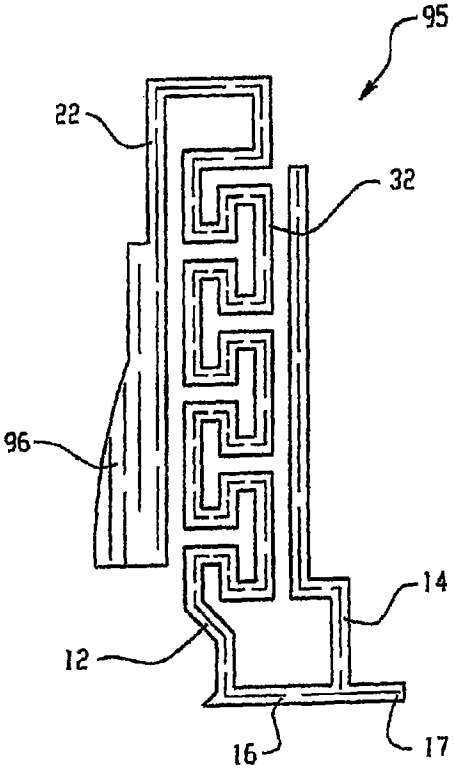
Figure 7:
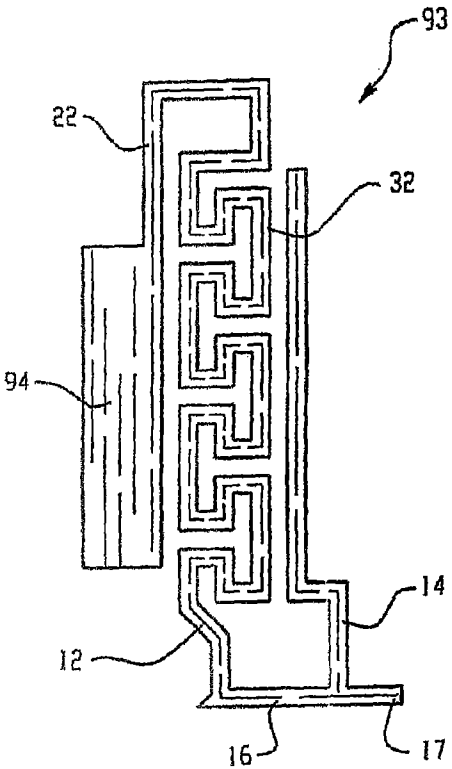

The multi-band monopole antennas 93, 95, 97 illustrated in FIGS. 7-9 are similar to the antenna 30 shown in FIG. 2, except in each of FIGS. 7-9 the expanded portion 22 of the first radiating arm 12 includes an additional area 94, 96, 98. In FIG. 7, the expanded portion 22 of the first radiating arm 12 includes a polygonal portion 94. In FIGS. 8 and 9, the expanded portion 22 of the first radiating arm 12 includes a portion 96, 98 with an arcuate longitudinal edge.

FIG. 10 is a top view 100 of the exemplary multi-band monopole antenna 10 of FIG. 1 coupled to the circuit board 102 of a mobile communications device. The circuit board 102 includes a feeding point 104 and a ground plane 106. The ground plane 106 may, for example, be located on one of the surfaces of the circuit board 102, or may be one layer of a multi-layer printed circuit board. The feeding point 104 may, for example, be a metallic bonding pad that is coupled to circuit traces 105 on one or more layers of the circuit board 102. Also illustrated, is communication circuitry 108 that is coupled to the feeding point 104. The communication circuitry 108 may, for example, be a multi-band transceiver circuit that is coupled to the feeding point 104 through circuit traces 105 on the circuit board.

In order to reduce electromagnetic interference from the ground plane 106, the antenna 10 is mounted within the mobile communications device such that the projection of the antenna footprint on the plane of the circuit board 102 does not intersect the metalization of the ground plane 106 by more than fifty percent. In the illustrated embodiment 100, the antenna 10 is mounted above the circuit board 102. That is, the circuit board 102 is mounted in a first plane and the antenna 10 is mounted in a second plane within the mobile communications device. In addition, the antenna 10 is laterally offset from an edge of the circuit board 102, such that, in this embodiment 100, the projection of the antenna footprint on the plane of the circuit board 102 does not intersect any of the metalization of the ground plane 106.

In order to further reduce electromagnetic interference from the ground plane 106, the feeding point 104 is located at a position on the circuit board 102 adjacent to a corner of the ground plane 106. The antenna 10 is preferably coupled to the feeding point 104 by folding a portion of the common conductor 16 perpendicularly towards the plane of the circuit board 102 and coupling the feeding port 17 of the antenna 10 to the feeding point 104 of the circuit board 102. The feeding port 17 of the antenna 10 may, for example, be coupled to the feeding point 104 using a commercially available connector, by bonding the feeding port 17 directly to the feeding point 104, or by some other suitable coupling means. In other embodiments, however, the feeding port 17 of the antenna 10 may be coupled to the feeding point 104 by some means other than folding the common conductor 16.

Figure 11:
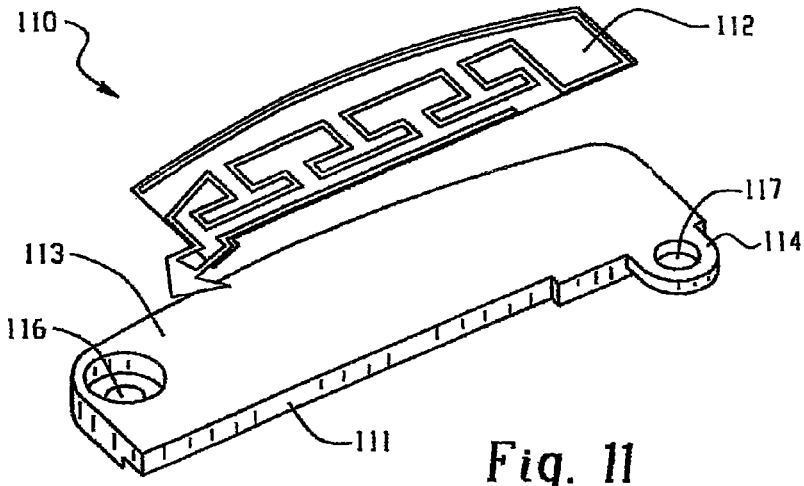
FIG. 11 shows an exemplary mounting structure for securing a multi-band monopole antenna within a mobile communications device.

FIG. 11 shows an exemplary mounting structure 111 for securing a multi-band monopole antenna 112 within a mobile communications device. The illustrated embodiment 110 employs a multi-band monopole antenna 112 having a meandering section similar to that shown in FIG. 2. It should be understood, however, that alternative multi-band monopole antenna configurations, as described in FIGS. 1-9, could also be used.

The mounting structure 111 includes a flat surface 113 and at least one protruding section 114. The antenna 112 is secured to the flat surface 113 of the mounting structure 111, preferably using an adhesive material. For example, the antenna 112 may be fabricated on a flex-film substrate having a peel-type adhesive on the surface opposite the antenna structure. Once the antenna 112 is secured to the mounting structure 111, the mounting structure 111 is positioned in a mobile communications device with the protruding section 114 extending over the circuit board. The mounting structure 111 and antenna 112 may then be secured to the circuit board and to the housing of the mobile communications device using one or more apertures 116, 117 within the mounting structure 111.

Figure 12:
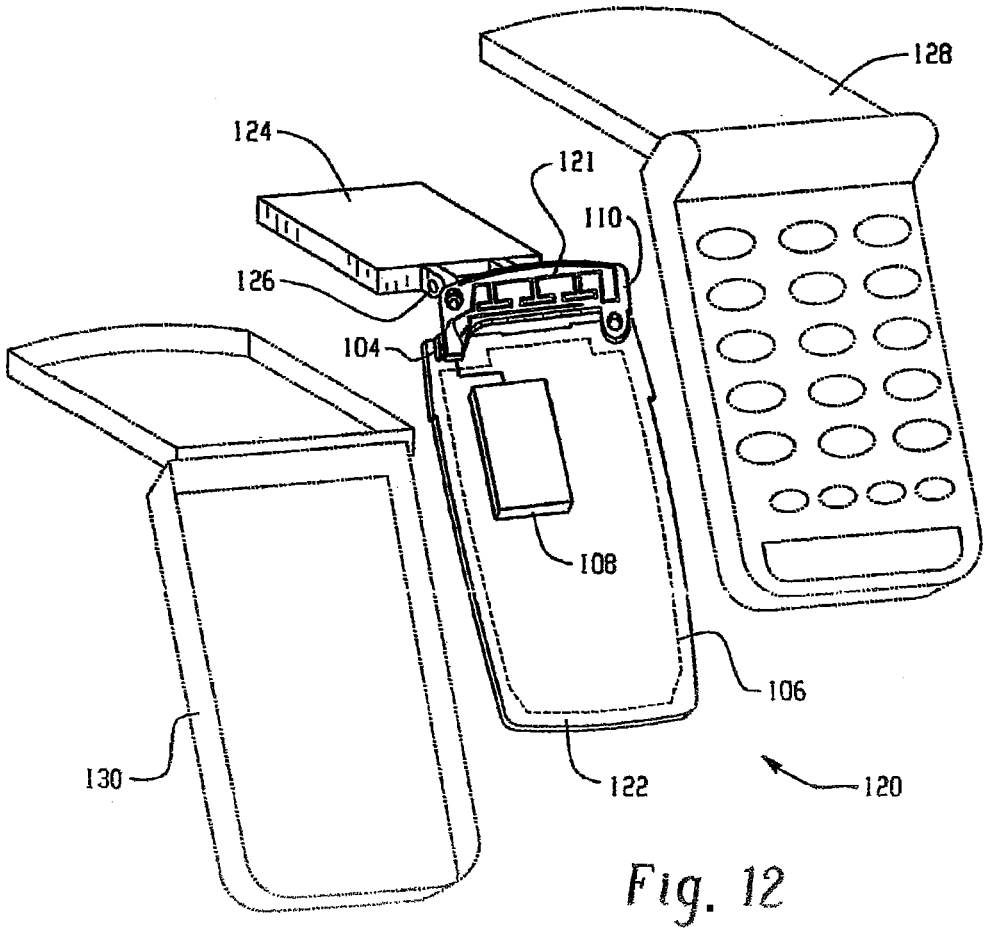
FIG. 12 is an exploded view of an exemplary clamshell-type cellular telephone having a multi-band monopole antenna.

FIG. 12 is an exploded view of an exemplary clamshell-type cellular telephone 120 having a multi-band monopole antenna 121. The cellular telephone 120 includes a lower circuit board 122, an upper circuit board 124, and the multi-band antenna 121 secured to a mounting structure 110. Also illustrated are an upper and a lower housing 128, 130 that join to enclose the circuit boards 122, 124 and antenna 121. The illustrated multi-band monopole antenna 121 is similar to the multi-band antenna 30 shown in FIG. 2. It should be understood, however, that alternative antenna configurations, as described above with reference to FIGS. 1-9, could also be used.

The lower circuit board 122 is similar to the circuit board 102 described above with reference to FIG. 10, and includes a ground plane 106, a feeding point 104, and communications circuitry 108. The multi-band antenna 121 is secured to a mounting structure 110 and coupled to the lower circuit board 122, as described above with reference to FIGS. 10 and 11. The lower circuit board 122 is then connected to the upper circuit board 124 with a hinge 126, enabling the upper and lower circuit boards 122, 124 to be folded together in a manner typical for clamshell-type cellular phones. In order to further reduce electromagnetic interference from the upper and lower circuit boards 122, 124, the multi-band antenna 121 is preferably mounted on the lower circuit board 122 adjacent to the hinge 126.

Figure 13:
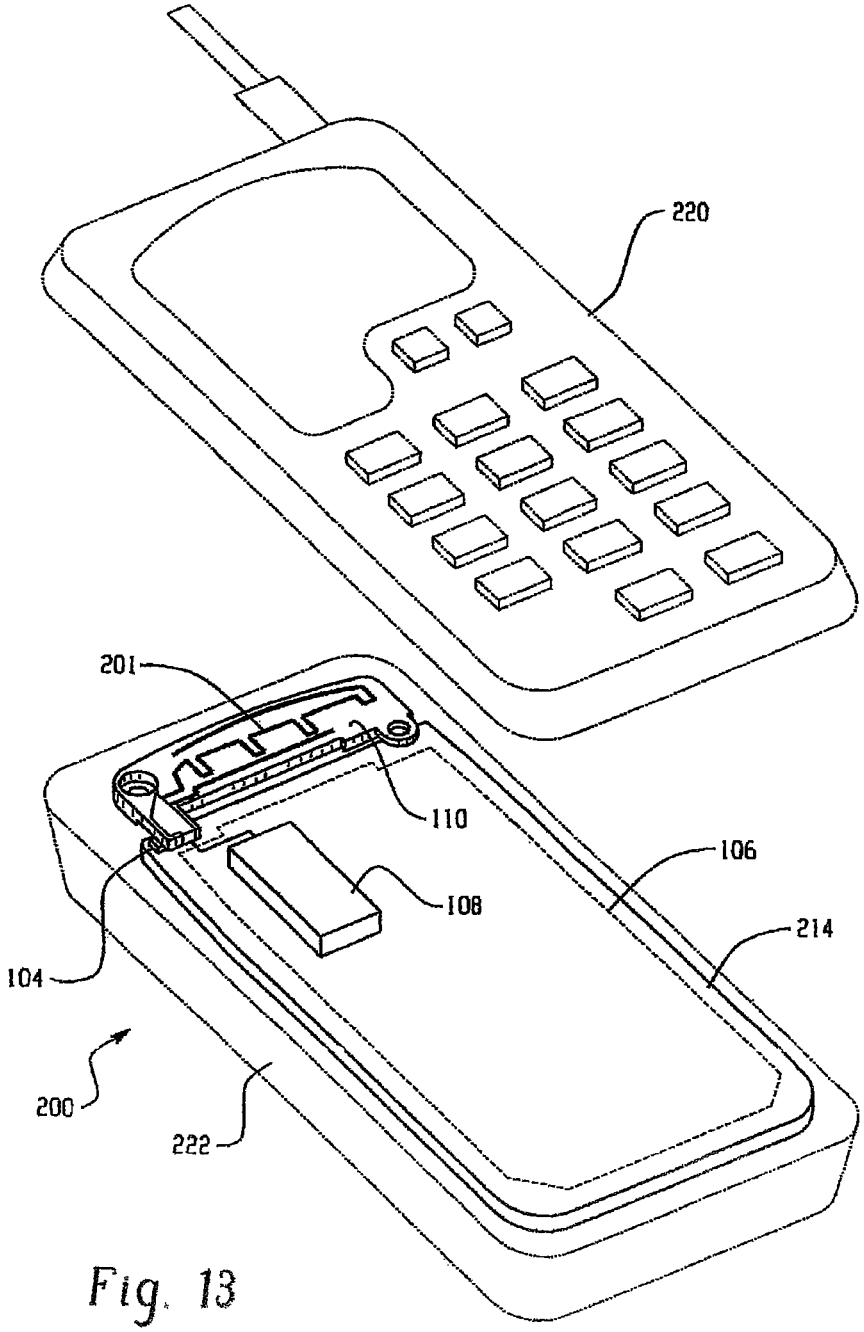
FIG. 13 is an exploded view of an exemplary candy-bar-style cellular telephone having a multi-band monopole antenna.

FIG. 13 is an exploded view of an exemplary candy-bar-type cellular telephone 200 having a multi-band monopole antenna 201. The cellular telephone 200 includes the multi-band monopole antenna 201 secured to a mounting structure 110, a circuit board 214, and an upper and lower housing 220, 222. The circuit board 214 is similar to the circuit board 102 described above with reference to FIG. 10, and includes a ground plane 106, a feeding point 104, and communications circuitry 108. The illustrated antenna 201 is similar to the multi-band monopole antenna shown in FIG. 3, however alternative antenna configurations, as described above with reference to FIGS. 1-9, could also be used.

The multi-band antenna 201 is secured to the mounting structure 110 and coupled to the circuit board 214 as described above with reference to FIGS. 10 and 11. The upper and lower housings 220, 222 are then joined to enclose the antenna 212 and circuit board 214.

Figure 14:
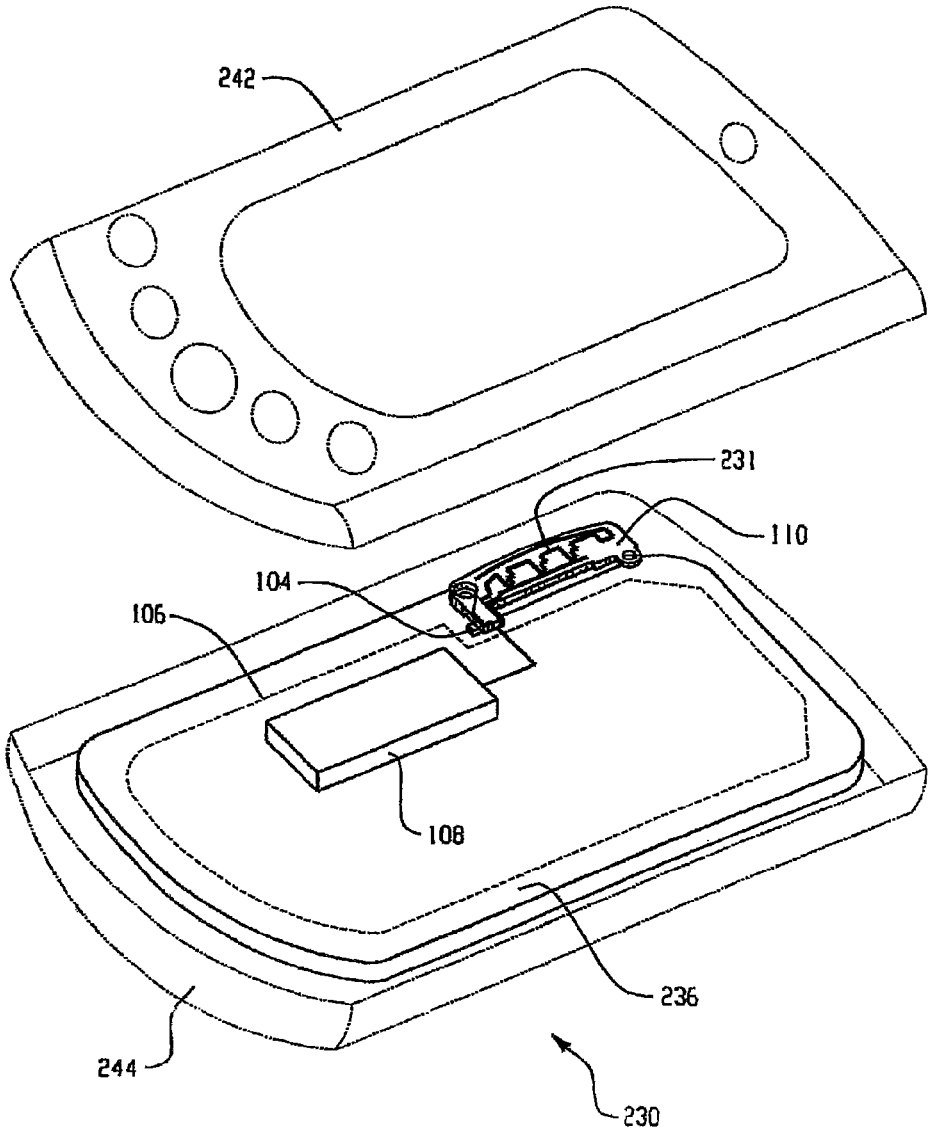
FIG. 14 is an exploded view of an exemplary personal digital assistant (PDA) having a multi-band monopole antenna.

FIG. 14 is an exploded view of an exemplary personal digital assistant (PDA) 230 having a multi-band monopole antenna 231. The PDA 230 includes the multi-band monopole antenna 231 secured to a mounting structure 110, a circuit board 236, and an upper and lower housing 242, 244. Although shaped differently, the PDA circuit board 236 is similar to the circuit board 102 described above with reference to FIG. 10, and includes a ground plane 106, a feeding point 104, and communications circuitry 108. The illustrated antenna 231 is similar to the multi-band monopole antenna shown in FIG. 5, however alternative antenna configurations, as described above with reference to FIGS. 1-9, could also be used.

The multi-band antenna 231 is secured to the mounting structure 110 and coupled to the circuit board 214 as described above with reference to FIGS. 10 and 11. In slight contrast to FIG. 10, however, the PDA circuit board 236 defines an L-shaped slot along an edge of the circuit board 236 into which the antenna 231 and mounting structure 110 are secured in order to conserve space within the PDA 230. The upper and lower housings 242, 244 are then joined together to enclose the antenna 231 and circuit board 236.

This written description uses examples to disclose the invention, including the best mode, and also to enable any person skilled in the art to make and use the invention. The patentable scope of the invention is defined by the claims, and may include other examples that occur to those skilled in the art.

What is claimed:

1. A mobile communication device comprising:

communications circuitry;

a circuit board comprising a ground plane and a feeding point, the feeding point being coupled to the communications circuitry;

a mounting structure positioned within the mobile communication device, a section of the mounting structure extending over the circuit board; and a multi-band antenna secured to the mounting structure and laterally offset from an edge of the ground plane, the multi-band antenna comprising:

a common conductor coupled to the feeding point;

first and second radiating arms coupled to and extending from the common conductor; and a space-filling curve constituting at least a part of the first radiating arm, wherein the space-filling curve comprises at least ten segments that are shorter than a tenth of a free-space operating wavelength of the multi-band antenna, each of the segments being connected to its neighboring segments at an angle such that no pair of adjacent segments defines a longer straight segment, wherein any periodicity of the space-filling curve along a fixed straight direction of space involves a periodic structure having a period defined by a non-periodic curve comprising at least ten connected segments in which no pair of adjacent ones of the connected segments defines a longer straight segment.

2. The mobile communication device of claim 1, wherein the antenna feeding point is located at a position on the circuit board corresponding to a corner of the ground plane.

3. The mobile communication device of claim 1, wherein a total length of the first radiating arm is greater than a total length of the second radiating arm.

4. The mobile communication device of claim 3, wherein the second radiating arm of the multi-band antenna includes a linear section adjacent to the first radiating arm.

5. The mobile communication device of claim 4, wherein the first radiating arm comprises a first section extending away from the common conductor in a first direction and a second section extending in a second direction that is different from the first direction.

6. The mobile communication device of claim 3, wherein the mobile communication device is a cellular telephone.

7. The mobile communication device of claim 3, wherein the multi-band antenna is configured to operate in at least three frequency bands.

8. A mobile communication device comprising:

communications circuitry;

a circuit board comprising a ground plane and a feeding point, the feeding point being coupled to the communications circuitry, the circuit board including a slot along an edge thereof;

a mounting structure coupled to the circuit board in the vicinity of the slot; and a multi-band antenna secured to the mounting structure and comprising:

a common conductor coupled to the feeding point;

a first radiating arm extending from the common conductor; and a second radiating arm extending from the common conductor and including at least three linear portions, wherein an orthogonal projection of a footprint of the multi-band antenna on a plane of the circuit board overlaps a metallization of the ground plane in less than fifty percent of an area of the footprint.

9. The mobile communication device of claim 8, wherein a total length of the first radiating arm is greater than a total length of the second radiating arm.

10. The mobile communication device of claim 9, wherein the first radiating arm comprises a space-filling curve extending from the common conductor, wherein the space-filling curve comprises at least ten segments that are shorter than a tenth of a free-space operating wavelength of the multi-band antenna, each of the segments being connected to its neighboring segments at an angle such that no pair of adjacent segments defines a longer straight segment, wherein any periodicity of the space-filling curve along a fixed straight direction of space involves a periodic structure having a period defined by a non-periodic curve comprising at least ten connected segments in which no pair of adjacent ones of the connected segments defines a longer straight segment.

11. The mobile communication device of claim 10, wherein the first radiating arm comprises a first section extending away from the common conductor in a first direction and a second section extending in a second direction that is different from the first direction.

12. The mobile communication device of claim 8, wherein the antenna feeding point is located at a position on the circuit board corresponding to a corner of the ground plane.

13. The mobile communication device of claim 8, wherein the antenna comprises a third radiating arm coupled to the common conductor.

14. A mobile communication device comprising:

a circuit board including an antenna feeding point and a ground plane;

communications circuitry coupled to the antenna feeding point of the circuit board; and a multi-band antenna mounted within the mobile communication device and comprising:

a common conductor coupled to the feeding point;

a first radiating arm coupled to the common conductor and having a section comprising a space-filling curve extending from the common conductor in a first direction and a contiguous extended substantially straight section extending from the section comprising the space-filling curve in a substantially opposite direction as the first direction; and a second radiating arm coupled to the common conductor, wherein an orthogonal projection of a footprint of the multi-band antenna on a plane of the circuit board intersects a metallization of the ground plane by less than fifty percent.

15. The mobile communication device of claim 14, wherein the circuit board is mounted in a first plane within the mobile communication device and the multi-band antenna is mounted in a second plane within the mobile communication device.

16. The mobile communication device of claim 15, wherein the antenna feeding point is located at a position on the circuit board corresponding to a corner of the ground plane.

17. The mobile communication device of claim 15, wherein an edge of the antenna is laterally aligned with an edge of the circuit board.

18. The mobile communication device of claim 15, wherein the antenna is offset laterally from the ground plane.

19. The mobile communication device of claim 14, wherein a total length of the first radiating arm is greater than a total length of the second radiating arm.

20. The mobile communication device of claim 14, wherein the mobile communication device is a cellular telephone.

* * * * *